US011346076B2

(12) United States Patent
Fukuda

(10) Patent No.: US 11,346,076 B2
(45) Date of Patent: May 31, 2022

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 320 days.

(21) Appl. No.: 16/678,370

(22) Filed: Nov. 8, 2019

(65) Prior Publication Data

US 2020/0149244 A1 May 14, 2020

(30) Foreign Application Priority Data

Nov. 14, 2018 (JP) ..... JP2018-214078
Nov. 14, 2018 (JP) ..... JP2018-214079

(51) Int. Cl.
*E02F 3/43* (2006.01)
*E02F 9/22* (2006.01)
*F15B 11/16* (2006.01)

(52) U.S. Cl.
CPC ..... *E02F 3/431* (2013.01); *E02F 9/2228* (2013.01); *E02F 9/2267* (2013.01); *F15B 11/16* (2013.01); *E02F 9/2282* (2013.01)

(58) Field of Classification Search
CPC ..... F15B 11/16; E02F 9/2282; E02F 9/2267
See application file for complete search history.

(56) References Cited

U.S. PATENT DOCUMENTS 3,303,753 A * 2/1967 McCay, Jr. ..... F15B 11/16 91/520
7,549,241 B2 * 6/2009 Ioku ..... E02F 3/432 37/348
2017/0175779 A1 * 6/2017 Fukuda ..... F15B 11/16

FOREIGN PATENT DOCUMENTS

JP 61294202 A * 12/1986
JP 2010270527 A 12/2010

* cited by examiner

*Primary Examiner* — Thomas E Lazo
(74) *Attorney, Agent, or Firm* — Greenblum & Bernstein, P.L.C.

(57) ABSTRACT

A hydraulic system includes a hydraulic pump, a first hydraulic actuator, a second hydraulic actuator, a first control valve to control the first hydraulic actuator, a second control valve connected to a downstream side of the first control valve and configured to control the second hydraulic actuator, a return fluid tube in which return fluid discharged from the first hydraulic actuator flows, the return fluid tube coupling the first control valve and the first hydraulic actuator, an internal fluid tube arranged in the first control valve and connected to the return fluid tube, an external fluid tube connected to the internal fluid tube, the external fluid tube coupling the first control valve and the second control valve, a branched fluid tube branched from the external fluid tube and connected to a discharge fluid tube, and a pressurizing portion provided to the discharge fluid tube.

20 Claims, 11 Drawing Sheets

HYDRAULIC SYSTEM FOR WORKING MACHINE

CROSS-REFERENCE TO RELATED APPLICATIONS

The present application claims priority under 35 U.S.C. § 119 to Japanese Patent Application No. P2018-214078, filed Nov. 14, 2018 and to Japanese Patent Application No. P2018-214079, filed Nov. 14, 2018. The contents of these applications are incorporated herein by reference in their entirety.

BACKGROUND OF THE INVENTION

Field of the Invention

The present invention relates to a hydraulic system for a working machine and to a control valve.

Description of Related Art

Japanese unexamined patent application publication No. 2010-270527 previously discloses a hydraulic system for a work machines. The working machine disclosed in Japanese unexamined patent application publication No. 2010-270527 includes a boom, a bucket, a boom cylinder for moving the boom, a bucket cylinder for moving the bucket, an auxiliary actuator for activating an auxiliary attachment, a first control valve for controlling the stretching and shortening of the boom cylinder, a second control valve for controlling the stretching and shortening of the bucket cylinder, and a third control valve for activating the auxiliary actuator.

SUMMARY OF THE INVENTION

A hydraulic system for a working machine, includes: a hydraulic pump to output operation fluid; a first hydraulic actuator; a second hydraulic actuator; a first control valve to control the first hydraulic actuator; a second control valve connected to a downstream side of the first control valve and configured to control the second hydraulic actuator; a return fluid tube in which return fluid discharged from the first hydraulic actuator flows, the return fluid tube coupling the first control valve and the first hydraulic actuator; an internal fluid tube arranged in the first control valve and connected to the return fluid tube; an external fluid tube connected to the internal fluid tube, the external fluid tube coupling the first control valve and the second control valve; a discharge fluid tube to discharge the operation fluid; a branched fluid tube branched from the external fluid tube and connected to the discharge fluid tube; and a pressurizing portion to increase a pressure in the discharge fluid tube, the pressurizing portion being provided to the discharge fluid tube.

A hydraulic system for a working machine, includes: a hydraulic pump to output operation fluid; a first hydraulic actuator; a second hydraulic actuator; a first control valve to control the first hydraulic actuator when switched to a predetermine switching position; a second control valve connected to a downstream side of the first control valve and configured to control the second hydraulic actuator; a return fluid tube in which return fluid discharged from the first hydraulic actuator flows, the return fluid tube coupling the first control valve and the first hydraulic actuator; a first internal fluid tube arranged in the first control valve and connected to the return fluid tube; an external fluid tube connected to the first internal fluid tube, the external fluid tube coupling the first control valve and the second control valve; a discharge fluid tube to discharge the operation fluid; a branched fluid tube branched from the external fluid tube and connected to the discharge fluid tube; a pressurizing portion to increase a pressure in the discharge fluid tube, the pressurizing portion being provided to the discharge fluid tube; and a second internal fluid tube arranged in the first control valve and communicated with the external fluid tube to return, to the first control valve, operation fluid having flowed to the external fluid tube when the first control valve is switched to the predetermined switching position.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
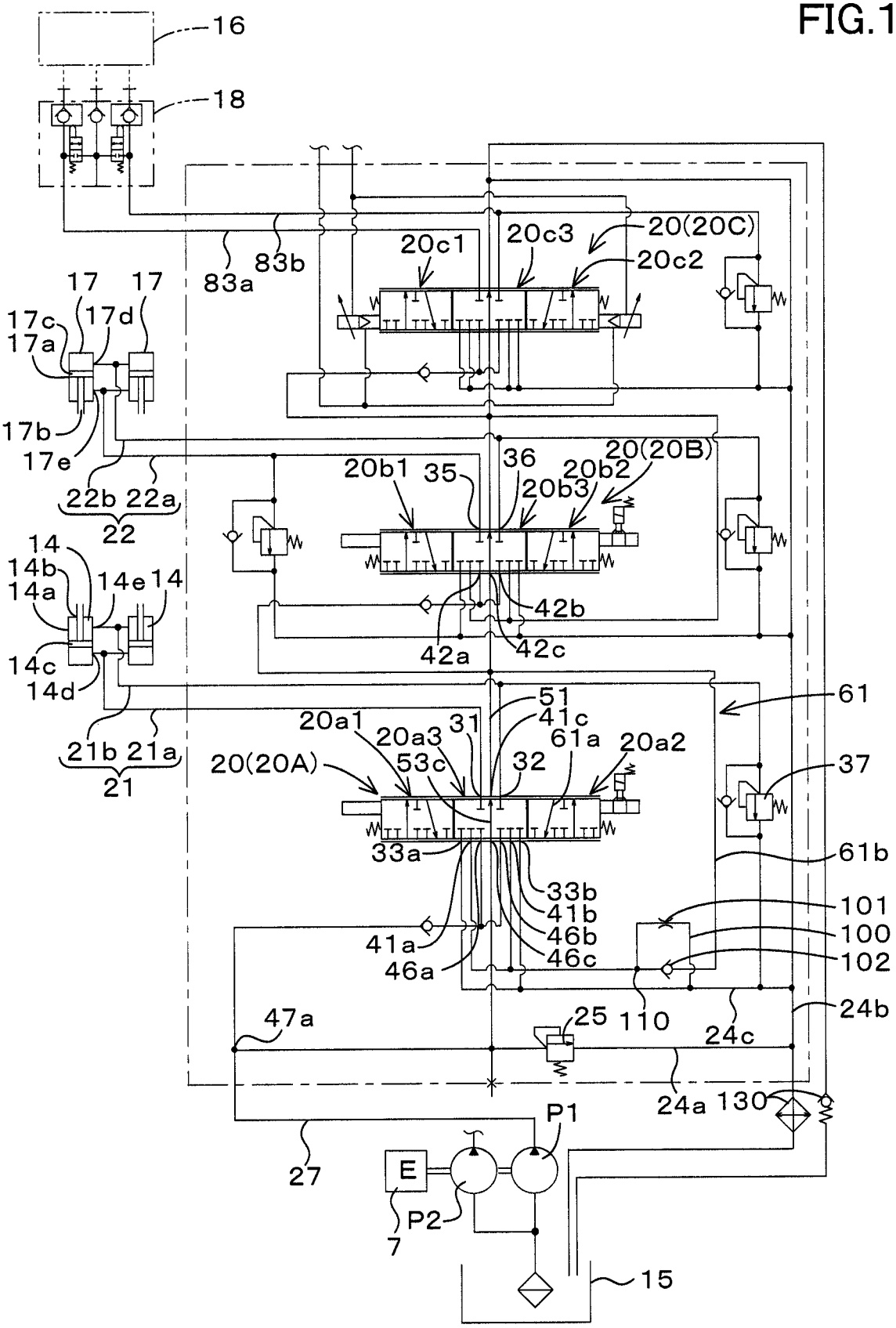
FIG. 1 is a view illustrating a hydraulic system (a hydraulic circuit) according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, embodiments of the present invention will be described below with reference to the drawings as appropriate.

Referring to the drawings, a hydraulic system for a working machine according to the embodiments and a working machine provided with the hydraulic system according to the embodiments will be described below.

First Embodiment

First, the working machine will be explained.

Figure 8:
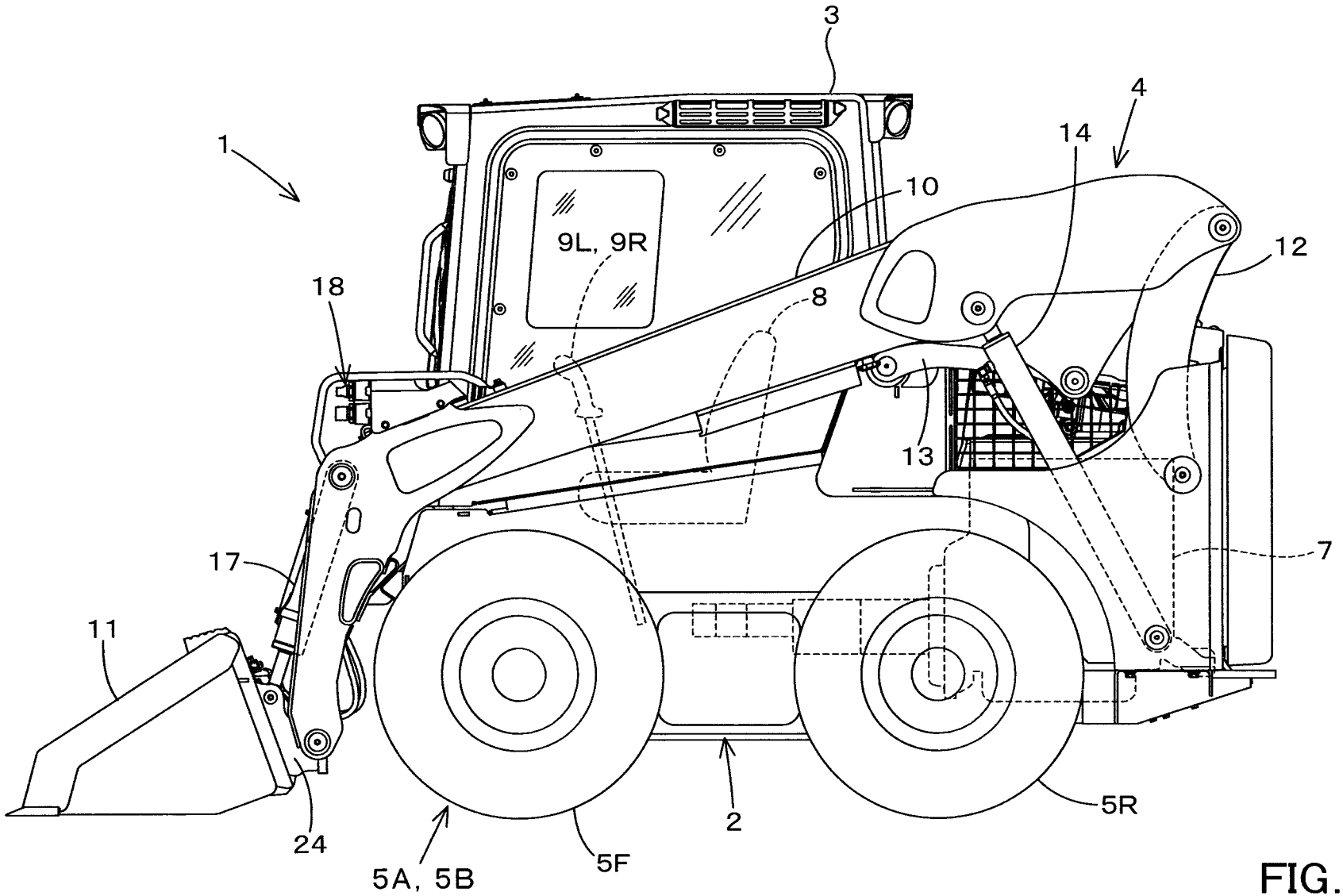
FIG. 8 is a whole view of a skid steer loader exemplified as a working machine according to the embodiment.

FIG. 8 shows a side view of the working machine according to the embodiments of the present invention. In FIG. 8, a skid steer loader is shown as an example of the working machine.

However, the working machine according to the present invention is not limited to the skid steerer, and may be another type of loader working machine such as a compact truck loader. In addition, a working machine other than the loader working machine may be employed.

The working machine 1 includes a machine body (a vehicle body) 2, a cabin 3, a working device 4, a traveling device 5A, and a traveling device 5B.

The cabin 3 is mounted on the machine body 2. An operator seat 8 is arranged at the rear portion of the cabin 3.

In explanation of the embodiments, the front side of the operator seated on the operator seat 8 of the working machine 1 (the left side in FIG. 8) is referred to as the front, the rear side of the operator (the right side in FIG. 8) is referred to as the rear, the left side of the operator (the front surface side of FIG. 8) is referred to as the left, and the right side of the operator (the back surface side of FIG. 8) is referred to as the right.

The horizontal direction, which is a direction orthogonal to the front-rear direction, will be described as a machine width direction. The direction from the center portion of the machine body 2 toward the right portion or the left portion will be described as a machine outward direction. In other words, the machine outward direction is the machine width direction and separates away from the machine body 2.

The direction opposite to the machine outward direction will be described as the machine inward direction. In other words, the machine inward direction is the machine width direction and is the direction approaching the machine body 2.

The cabin 3 is mounted on the machine body 2. The working device 4 is a device that performs the working, and is installed on the machine body 2.

The traveling device 5A is a device provided for the traveling of the machine body 2, and is arranged on the left side of the machine body 2. The traveling device 5B is a device provided for the traveling of the machine body 2, and is arranged on the right side of the machine body 2. A prime mover 7 is arranged inside at the rear portion of the machine body 2.

The prime mover 7 is a diesel engine (an engine). The prime mover 7 is not limited to the engine, and may be an electric motor or the like.

A traveling lever 9L is arranged on the left side of the operator seat 8. A traveling lever 9R is arranged on the right side of the operator seat 8. The traveling lever 9L arranged on the left is provided for operating the traveling device 5A arranged on the left, and the traveling lever 9R arranged on the right is provided for operating the traveling device 5B arranged on the right.

The working device 4 includes a boom 10, a bucket 11, a lift link 12, a control link 13, a boom cylinder 14, and a bucket cylinder 17. The boom 10 is arranged on the side of the machine body 2.

The bucket 11 is arranged on the tip end (a front end) of the boom 10. The lift link 12 and the control link 13 support the base portion (a rear portion) of the boom 10. The boom cylinder 14 moves the boom 10 upward or downward.

In particular, the lift link 12, the control link 13, and the boom cylinder 14 are arranged on the side of the machine body 2. The upper portion of the lift link 12 is pivotally supported by the upper portion of the base portion of the boom 10. The lower portion of the lift link 12 is pivotally supported on the side portion of the rear portion of the machine body 2.

The control link 13 is arranged in front of the lift link 12. One end of the control link 13 is pivotally supported by the lower portion of the base portion of the boom 10, and the other end is pivotally supported by the machine body 2.

The boom cylinder 14 is a hydraulic cylinder configured to move the boom 10 upward and downward. The upper portion of the boom cylinder 14 is pivotally supported by the front portion of the base portion of the boom 10. The lower portion of the boom cylinder 14 is pivotally supported by the side portion of the rear portion of the machine body 2. When the boom cylinder 14 is stretched and shortened, the boom 10 is swung up and down by the lift link 12 and the control link 13.

The bucket cylinder 17 is a hydraulic cylinder configured to swing the bucket 11. The bucket cylinder 17 couples the left portion of the bucket 11 and the left boom, and couples the right portion of the bucket 11 and the right boom.

An auxiliary attachment such as a hydraulic crusher, a hydraulic breaker, an angle broom, an auger, a pallet fork, a sweeper, a mower, and a snow blower can be attached to the tip end (a front portion) of the boom 10 instead of the bucket 11.

In the present embodiment, the traveling devices 5A and 5B respectively employ wheel type traveling devices 5A and 5B each of which has a front wheel 5F and a rear wheel 5R. Note that the traveling devices 5A and 5B may respectively employ crawler type (including semi-crawler type) traveling devices 5A and 5B.

Next, a working hydraulic circuit (a working hydraulic system) provided in the skid steer loader 1 will be described.

The working hydraulic system is a system for operating the boom 10, the bucket 11, the auxiliary attachment, and the like. As shown in FIG. 1, the working hydraulic system includes a plurality of control valves 20 and a hydraulic pump P1 (a first hydraulic pump) for the working. In addition, the working hydraulic system includes a second hydraulic pump P2 different from the first hydraulic pump P1.

The first hydraulic pump P1 is a pump configured to be operated by the power of the prime mover 7, and is constituted of a constant displacement gear pump (a fixed displacement gear pump). The first hydraulic pump P1 is configured to output the operation fluid stored in the tank 15 (the operation fluid tank).

The second hydraulic pump P2 is a pump configured to be operated by the power of the prime mover 7, and is constituted of a constant displacement gear pump (a fixed displacement gear pump). The second hydraulic pump P2 is configured to output the operation fluid stored in the tank 15 (the operation fluid tank).

The second hydraulic pump P2 outputs the operation fluid for signal and the operation fluid for control in the hydraulic system. The operation fluid for signal and the operation fluid for control are referred to as the pilot fluid.

The plurality of control valves 20 are valves configured to control various hydraulic actuators provided in the working machine 1. The hydraulic actuator is a device configured to be operated with the operation fluid, such as a hydraulic cylinder or a hydraulic motor. In this embodiment, the plurality of control valves 20 includes a boom control valve 20A, a bucket control valve 20B, and an auxiliary control valve 20C.

The boom control valve 20A is a valve configured to control a hydraulic actuator 14 (a boom cylinder) that operates the boom 10. The boom control valve 20A is a three-position switching valve of direct-acting spool type. The boom control valve 20A is switched between a neutral position 20*a*3, a first position 20*a*1 other than the neutral position 20*a*3, a second position 20*a*2 other than the neutral position 20*a*3 and the first position 20*a*1.

In the boom control valve 20A, the switching between the neutral position 20*a*3, the first position 20*a*1, and the second position 20*a*2 are performed by moving the spool through the operation of the operation member.

The switching of the boom control valve 20A is performed by directly moving the spool through operation of the operation member. However, the spool may be moved by the hydraulic operation (the hydraulic operation by the pilot valve, the hydraulic operation by the proportional valve). In addition, the spool may be moved by an electric operation (an electric operation by magnetizing a solenoid) or may be moved by other methods.

The boom control valve 20A and the first hydraulic pump P1 are connected by an output fluid tube 27. In addition, the boom control valve 20A and the boom cylinder 14 are connected by a fluid tube 21.

In particular, the boom cylinder 14 includes a cylinder body 14*a*, a rod 14*b* provided movably on the cylinder body 14*a*, and a piston 14*c* provided on the rod 14*b*. A first port 14*d* through which the operation fluid is supplied and discharged is provided at the base end portion of the cylinder body 14*a* (at the side opposite to the rod 14*b* side). A second port 14*e* through which the operation fluid is supplied and discharged is provided at the tip end (at the rod 14*b* side) of the cylinder body 14*a*.

The fluid tube 21 includes a first connecting fluid tube 21*a* that connects the first port 31 of the boom control valve 20A and the first port 14*d* of the boom cylinder 14, and includes a second connecting fluid tube 21*b* that connects the second port 32 of the boom control valve 20A and the second port 14*e* of the boom cylinder 14.

Thus, when the boom control valve 20A is set to be in the first position (the lifting position) 20*a*1, the operation fluid can be supplied from the first connecting fluid tube 21*a* to the first port 14*d* of the boom cylinder 14. In addition, the operation fluid can be discharged from the second port 14*e* of the boom cylinder 14 to the second connecting fluid tube 21*b*. In this manner, the boom cylinder 14 is stretched, and thereby the boom 10 is lifted.

When the boom control valve 20A is set to be in the second position (the lowering position) 20*a*2, othe peration fluid can be supplied from the second connecting fluid tube 21*b* to the second port 14*e* of the boom cylinder 14. In addition, the operation fluid can be discharged from the first port 14*d* of the boom cylinder 14 to the first connecting fluid tube 21*a*. In this manner, the boom cylinder 14 is shortened and thereby the boom 10 is lowered.

The bucket control valve 20B is a valve configured to control a hydraulic cylinder (a bucket cylinder) 17 that controls the bucket 11. The bucket control valve 20B is a direct acting spool type three-position switching valve of pilot type. The bucket control valve 20B is switched between a neutral position 20*b*3, a first position 20*b*1 different from the neutral position 20*b*3, and a second position 20*b*2 different from the neutral position 20*b*3 and the first position 20*b*1. In the bucket control valve 20B, the switching between the neutral position 20*b*3, the first position 20*b*1, and the second position 20*b*2 is performed by moving the spool through operation of the operation member.

The switching of the bucket control valve 20B is switched by directly moving the spool through the manual operation of the operation member. However, the spool may be moved by the hydraulic operation (the hydraulic operation by the pilot valve, the hydraulic operation by the proportional valve). In addition, the spool may be moved by an electric operation (an electric operation by magnetizing a solenoid) or may be moved by other methods.

The bucket control valve 20B and the bucket cylinder 17 are connected by a fluid tube 22. In particular, the bucket cylinder 17 includes a cylinder body 17*a*, a rod 17*b* that is movably provided on the cylinder body 17*a*, and a piston 17*c* that is provided on the rod 17*b*.

A first port 17*d* through which the operation fluid is supplied and discharged is provided at the base end portion of the cylinder body 17*a* (the side opposite to the rod 17*b* side). A second port 17*e* through which the operation fluid is supplied and discharged is provided at the tip end (the rod 17*b* side) of the cylinder body 17*a*.

The fluid tube 22 includes a first connecting fluid tube 22*a* that connects the first port 35 of the bucket control valve 20B and the second port 17*e* of the bucket cylinder 17, and a second connecting fluid tube 22*b* that connects a second port 36 of the bucket control valve 20B and the first port 17*d* of the bucket cylinder 17.

Thus, when the bucket control valve 20B is set to be in the first position (the shoveling position) 20*b*1, the operation fluid can be supplied from the first connecting fluid tube 22*a* to the second port 17*e* of the bucket cylinder 17. In addition, the operation fluid can be discharged from the first port 17*d* of the bucket cylinder 17 to the second connecting fluid tube 22*b*. In this manner, the bucket cylinder 17 is shortened and thereby the bucket 11 performs the shoveling operation.

When the bucket control valve 20B is set to be in the second position (the dumping position) 20*a*2, the operation fluid can be supplied from the second connecting fluid tube 22*b* to the first port 17*d* of the bucket cylinder 17. In addition, the operation fluid can be discharged from the second port 17*e* of the bucket cylinder 17 to the first connecting fluid tube 22*a*. In this manner, the bucket cylinder 17 is stretched and thereby performs the dumping operation.

The auxiliary control valve 20C is a valve configured to control the hydraulic actuator (the hydraulic cylinder, the hydraulic motor, and the like) 16 mounted on the auxiliary attachment. The auxiliary control valve 20C is a direct acting spool type three-position switching valve of pilot type. The auxiliary control valve 20C is switched between a neutral position 20*c*3, a first position 20*c*1 different from the neutral position 20*c*3, and a second position 20*c*2 different from the first position 20*c*1 and the neutral position 20*c*3.

In the auxiliary control valve 20C, the switching between the neutral position 20*c*3, the first position 20*c*1, and the second position 20*c*2 is switched by moving the spool with a pressure of the pilot fluid. A connecting member 18 is connected to the auxiliary control valve 20C by the supply/discharge fluid tube 83*a* and the supply/discharge fluid tube 83*b*. The connecting member 18 is connected to a fluid tube connected to the hydraulic actuator 16 (an auxiliary hydraulic actuator) for the auxiliary attachment.

Thus, when the auxiliary control valve 20C is set to the first position 20*c*1, the operation fluid can be supplied from the supply/discharge fluid tube 83*a* to the hydraulic actuator 16 of the auxiliary attachment. When the auxiliary control valve 20C is set to be in the second position 20*c*2, the operation fluid can be supplied from the supply/discharge fluid tube 83*b* to the hydraulic actuator 16 of the auxiliary attachment.

In this manner, when the operation fluid is supplied, to the hydraulic actuator 16, from the supply/discharge fluid tube 83*a* or the supply/discharge fluid tube 83*b*, the hydraulic actuator 16 (the auxiliary attachment) can be operated.

Now, the hydraulic system according to the embodiment employs a series circuit (a series fluid tube). In the series circuit, the operation fluid returned from the hydraulic actuator to the control valve arranged on the upstream side can be supplied to the control valve arranged on the downstream side.

For example, focusing on the boom control valve 20A and the bucket control valve 20B, the boom control valve 20A is a control valve arranged on the upstream side, and the bucket control valve 20B is a control valve arranged on the downstream side.

Hereinafter, the control valve arranged on the upstream side is referred to as a "first control valve", and the control valve arranged on the downstream side is referred to as a "second control valve". In addition, the hydraulic actuator corresponding to the first control valve is referred to as a "first hydraulic actuator", and the hydraulic actuator corresponding to the second control valve is referred to as a "second hydraulic actuator". The fluid tube that supplies, to the second control valve, the return fluid which is the operation fluid that returns from the first hydraulic actuator to the first control valve is referred to as a "first fluid tube".

In this embodiment, the boom control valve 20A is the "first control valve", and the bucket control valve 20B is the "second control valve". In addition, the boom cylinder 14 is the "first hydraulic actuator", and the bucket cylinder 17 is the "second hydraulic actuator".

Hereinafter, the first control valve and the second control valve will be described in detail.

The first control valve 20A and the output portion of the first hydraulic pump P1 are connected by the output fluid tube 27. The output fluid tube 27 is branched at the middle portion 47*a*, and reaches the first control valve 20A.

The fluid tube branched from the output fluid tube 27 is connected to the first input port 46*a* and the second input port 46*b* of the first control valve 20A. In addition, the output fluid tube 27 is connected to the third input port 46*c* of the first control valve 20A.

In this manner, the operation fluid outputted from the first hydraulic pump P1 is capable of being supplied into the first control valve 20A through the output fluid tube 27, the first input port 46*a*, the second input port 46*b*, and the third input port 46*c*. In the output fluid tube 27, the discharge fluid tube 24 capable of discharging the operation fluid is connected to a section between the middle portion 47*a* and the third input port 46*c*.

The discharge fluid tube 24 includes a first discharge fluid tube 24*a* provided with a relief valve (a main relief valve) 25 that is capable of discharging the operation fluid when the pressure in the output fluid tube 27 becomes a predetermined pressure or more (a set pressure or more), a second discharge fluid tube 24*b* that is connected to the first discharge fluid tube 24*a* and reaches a discharging portion through which the operation fluid is discharged, and a third discharge fluid tube 24*c* that is connected to the second discharge fluid tube 24*b* and reaches the first discharging port 33*a* and the second discharge port 33*b* of the first control valve 20A.

The discharging portion is an operation fluid tank and a suction portion of the hydraulic pump (a portion through which the operation fluid is sucked). In addition, the discharging portion should just be a portion from which the operation fluid is discharged, and may be other than the operation fluid tank and the suction portion of the hydraulic pump, and is not limited thereto.

A pressurizing portion 130 is provided in the second discharge fluid tube 24*b*. The pressurizing portion 130 is a portion configured to increase the pressure in the discharged fluid tube 24. In addition, the pressurizing portion 130 is provided in the fourth discharge fluid tube arranged in parallel with the second discharge fluid tube 24*b* in the discharge fluid tube 24.

The pressurizing portion 130 is an oil cooler, a relief valve, a throttle portion (a throttle valve), a choke valve, a check valve, or the like. A plurality of the pressurizing portions 130 may be provided in the second discharge fluid tube 24*b*, and may be arranged in series or in parallel.

The set pressure in the pressurizing portion 130 is very low compared to the main relief valve 25, and is, for example, 1/20 to 1/100. For example, when the set pressure of the main relief valve 25 is 20 MPa, the set pressure of the pressurizing portion 130 is 0.2 MPa to 1.0 MPa.

The first control valve 20A and the second control valve 20B are connected by a center fluid tube 51. The center fluid tube 51 connects the third output port 41*c* of the first control valve 20A and the third input port 42*c* of the second control valve 20B.

In addition to the center fluid tube 51, the first control valve 20A and the second control valve 20B are connected by the first fluid tube 61. The first fluid tube 61 is a fluid tube allowing the return fluid returning from the first hydraulic actuator 14 to the first control valve 20A to flow through the first control valve 20A and to be supplied to the second control valve 20B.

The first fluid tube 61 includes the first connecting fluid tube (the first return fluid tube) 21*a*, the internal fluid tube 61*a*, and the external fluid tube 61*b*. The first connecting fluid tube 21*a* is a fluid tube that connects the first port 31 of the first control valve 20A and the first port 14*d* of the first hydraulic actuator 14, that is, a first return fluid tube through which the return fluid discharged from the first port 14*d* of the first hydraulic actuator 14 flows.

The internal fluid tube 61*a* is a fluid tube that is provided in the first control valve 20A and communicates with the first return fluid tube 21*a*. In particular, the internal fluid tube 61*a* is a fluid tube that connects the first port 31 of the first control valve 20A and the first output port 41*a* of the first control valve 20A when the first control valve 20A is set to be in the second position 20*a*2.

The external fluid tube 61*b* is a fluid tube that is connected to the second control valve 20B and communicates with the internal fluid tube 61*a*. The external fluid tube 61*b* connects the first output port 41*a* of the first control valve 20A and the first input port 42*a* of the second control valve 20B, and connects the second output port 41*b* of the first control valve 20A and the second input port 42*b* of the second control valve 20B. A middle portion of the external fluid tube 61*b* is connected to the center fluid tube 53*c*.

According to the the above configuration, when the first control valve 20A is set to be in the second position (the lifting position) 20*a*2, the first connecting fluid tube (the first return fluid tube) 21*a*, the internal fluid tube 61*a*, and the external fluid tube 61*b* are connected. In this manner, the return fluid returned from the first hydraulic actuator 14 to the first control valve 20A is supplied to the second control valve 20B through the first return fluid tube 21*a*, the internal fluid tube 61*a*, and the external fluid tube 61*b*.

Now, the working hydraulic system is capable of discharging the return fluid flowing through the external fluid tube 61*b* and is capable of returning the operation fluid in the discharge fluid tube 24 to the external fluid tube 62*b*. The working hydraulic system includes a branched fluid tube 100.

The branched fluid tube 100 is a fluid tube provided on the downstream side of the spool of the first control valve 20A and branched from the external fluid tube 61*b*, that is, a fluid tube through which the return fluid having flowed in the external fluid tube 61*b* flows. One end of the branched fluid tube 100 is connected to the external fluid tube 61*b*, and the other end is connected to the third discharge fluid tube 24*c*.

A throttle portion 101 is connected to the branched fluid tube 100. The throttle portion 101 is configured, for example, by making a partial portion of the branched fluid tube 100 thinner than other portions. In other words, the throttle portion 101 is configured by making the cross-sectional area of the portion where the operation fluid flows in the branched fluid tube 100 smaller than other portions. In addition, the structure of the branched fluid tube 100 is not limited to the example mentioned above.

A check valve 102 is connected to the external fluid tube 61*b*. The check valve 102 is a valve that allows the return fluid to flow from the first control valve 20A to the second control valve 20B and blocks the operation fluid from flowing from the second control valve 20B to the branched fluid tube 100.

In particular, the check valve 102 is arranged on a section between the first connecting portion 110 that connects the external fluid tube 61*b* and the branched fluid tube 100 and a second connecting portion (the first input port 42*a*, the second input port 42*b*) that connects the external fluid tube 61*b* and the second control valve 20C.

Thus, when the first control valve 20A is set to be in the second position (the lowering position) 20*a*2, the return fluid that flows through the first return fluid tube 21*a*, the internal fluid tube 61*a*, and the external fluid tube 61*b* and returns from the first hydraulic actuator 14 to the second control valve 20B is extremely reduced under the state where the first hydraulic actuator 14 is shortened to the stroke end (the end portion).

In addition, under the state where the first hydraulic actuator 14 is shortened to the stroke end (the end portion), the third input port 46*c* and the third output port 41*c* are not in communication in the first control valve 20A, and the communication is closed between the third input port 46*c* and the third output port 41*c*. Thus, the operation fluid of the first hydraulic pump P1 flows through the main relief valve 25 to the first discharged fluid tube 24*a*.

Figure 2:
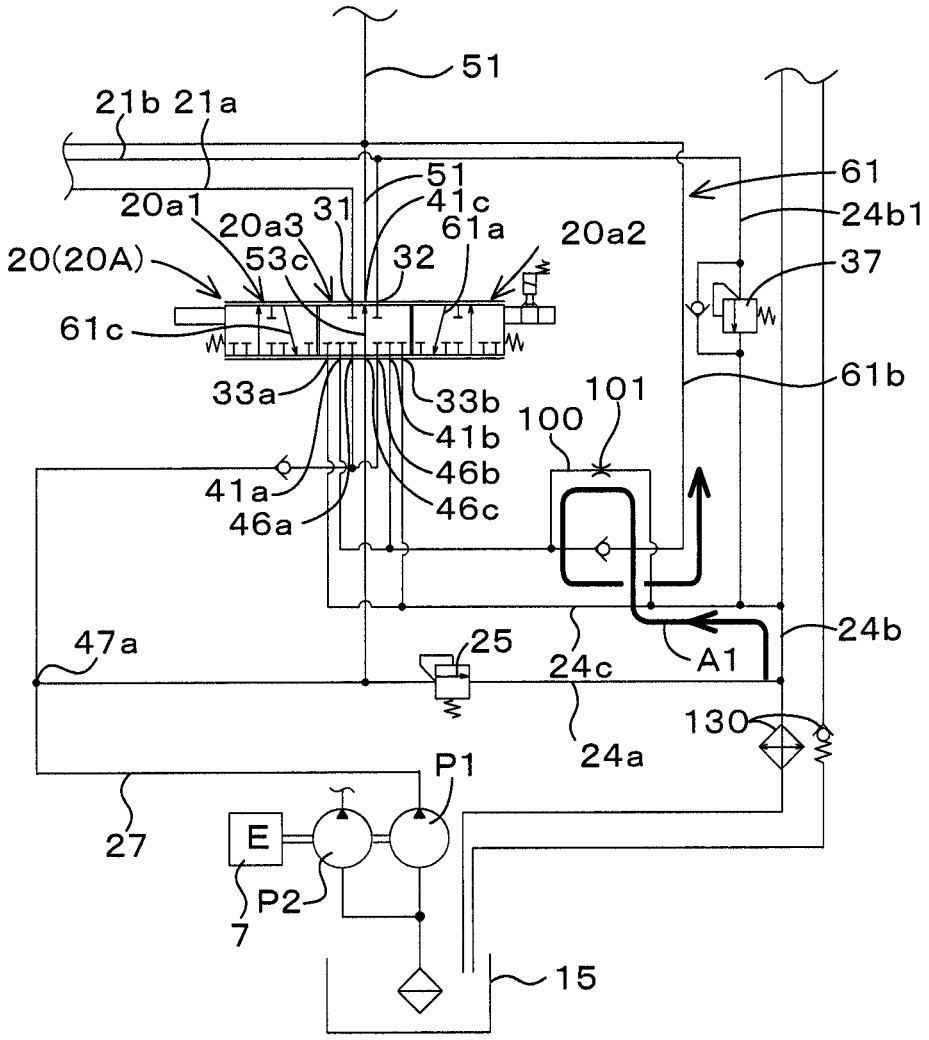
FIG. 2 is a view explaining a flow of operation fluid from a discharge fluid tube according to the first embodiment.

Here, as indicated by an arrowed line A1 in FIG. 2, the second discharge fluid tube 24*b* is provided with the pressurizing portion 130, so that the operation fluid in the third discharge fluid tube 24*c* communicated with the second discharge fluid tube 24*b* can flow to the external fluid tube 61*b* through the branched fluid tube 100.

That is, when the first hydraulic actuator 14 is shortend to the stroke end, a flow rate of the return fluid returning from the first hydraulic actuator 14 toward the external fluid tube 61*b* is low. However, the operation fluid flowing from the discharge fluid tube 24 (the third discharge fluid tube 24*c*) is supplemented to the operation fluid flowing to the external fluid tube 61*b*, and thus the second control valve 20B can be moved smoothly.

In addition, as shown in FIG. 2, the first fluid tube 61 may be constituted of the second connecting fluid tube (the second return fluid tube) 21*b*, the internal fluid tube 61*c*, and the external fluid tube 61*b*. The second connecting fluid tube 21*b* is a fluid tube that connects the second port 32 of the first control valve 20A and the second port 14*e* of the first hydraulic actuator 14, that is, a second return fluid tube through which the return fluid discharged from the second port 14*e* of the first hydraulic actuator 14 flows.

The internal fluid tube 61*c* is a fluid tube that is provided in the first control valve 20A and communicates with the second return fluid tube 21*b*. In particular, the internal fluid tube 61*c* a fluid tube that connects the second port 32 of the first control valve 20A and the second output port 41*b* of the first control valve 20A when the first control valve 20A is set to be in the first position 20*a*1.

In this case, when the first hydraulic actuator 14 is stretched to the stroke end, a flow rate of the return fluid returning from the first hydraulic actuator 14 toward the external fluid tube 61*b* through the second return fluid tube 21*b* is low. However, the operation fluid flowing from the discharge fluid tube 24 to the branched fluid tube 100 can be supplemented to the operation fluid flowing to the external fluid tube 61*b*, and thus the second control valve 20B can be moved smoothly.

Figure 4A:
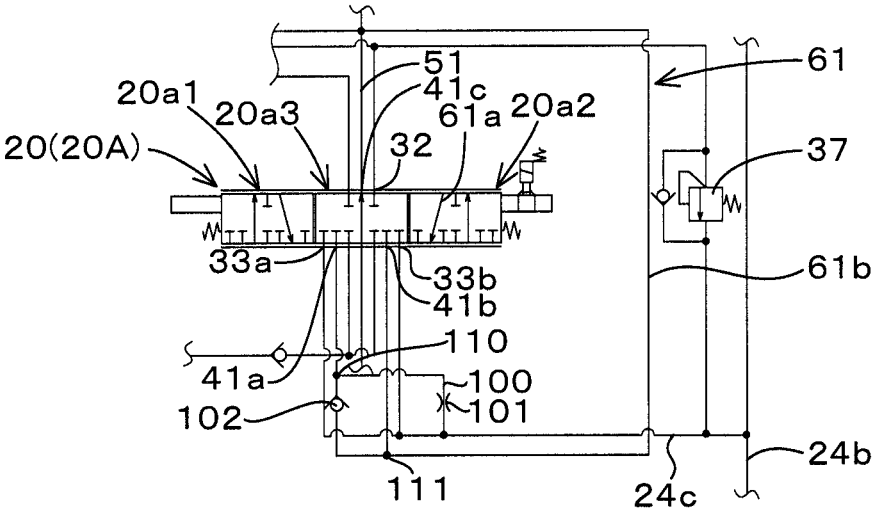
FIG. 4A is a view illustrating a first modified example of a check valve and a return discharge fluid tube according to the second embodiment.

As shown in FIG. 4A, in the external fluid tube 61*b*, a check valve 102 may be provided on the upstream side of the confluent portion 111 where the fluid tube connected to the first output port 41*a* is confluent with the fluid tube connected to the second output port 41*b*.

In this case, in the external fluid tube 61*b*, the branched fluid tube 100 is connected to a section between the first output port 41*a* of the first control valve 20A and the confluent portion 111, that is, a section on which the check valve 102 is provided.

In this manner, when the boom 10 is lowered (when the boom control valve 20A is set to be in the second position 20*a*2), the operation fluid in the discharge fluid tube 24 (the third discharge fluid tube 24*c*) can be supplemented to the external fluid tube 61*b* through the branched fluid tube 100.

Figure 4B:
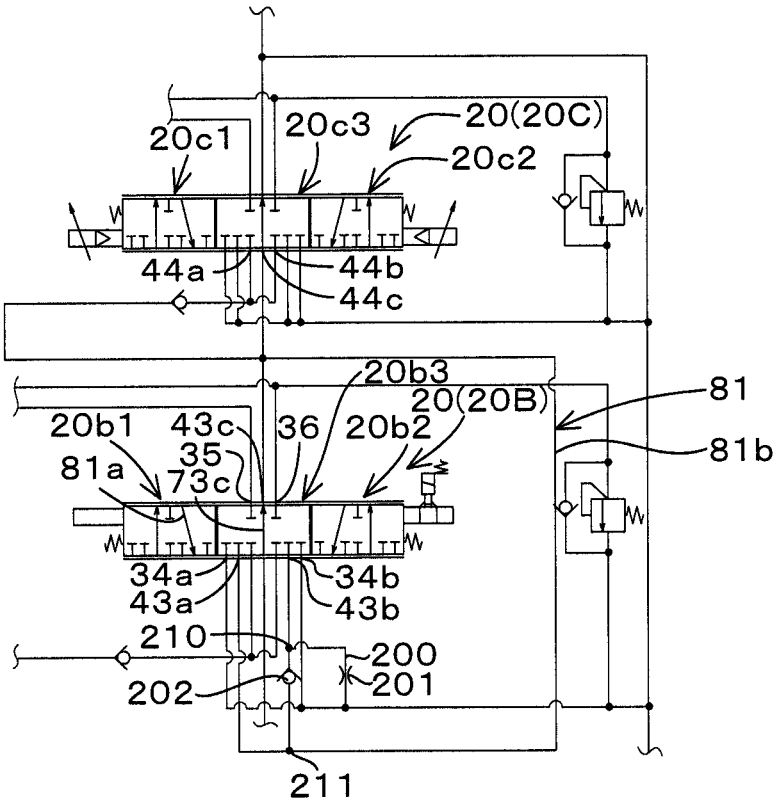
FIG. 4B is a view illustrating a second modified example of the check valve and the return discharge fluid tube according to the second embodiment.
Figure 4C:
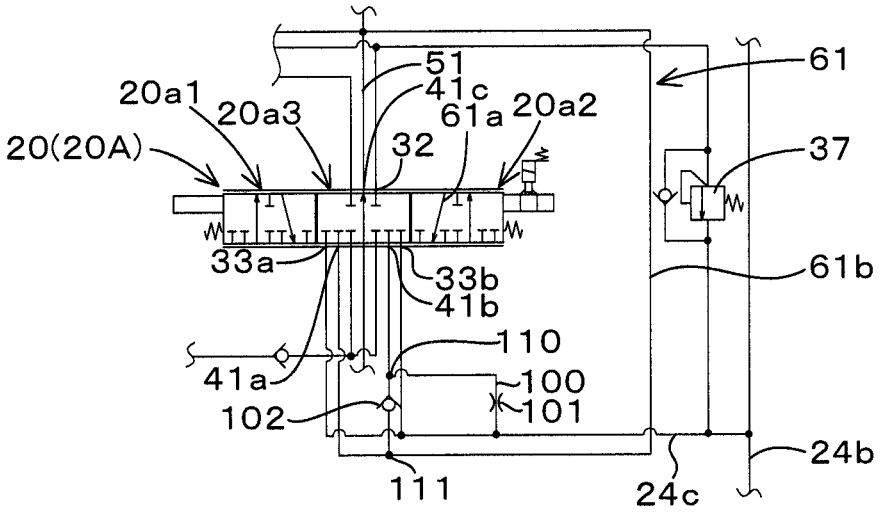
FIG. 4C is a view illustrating a third modified example of the check valve and the return discharge fluid tube according to the second embodiment.

In addition, as shown in FIG. 4C, the branched fluid tube 100 may be connected to a section between the second output port 41*b* of the first control valve 20A and the confluent portion 111 in the external fluid tube 61*b*. In this manner, when the boom 10 is lifted (when the boom control valve 20A is set to be in the first position 20*a*1), the hydraulic fluid in the discharge fluid tube 24 (the third discharge fluid tube 24*c*) can be supplied to the external fluid tube 61*b* through the branched fluid tube 100.

Second Embodiment

Figure 3:
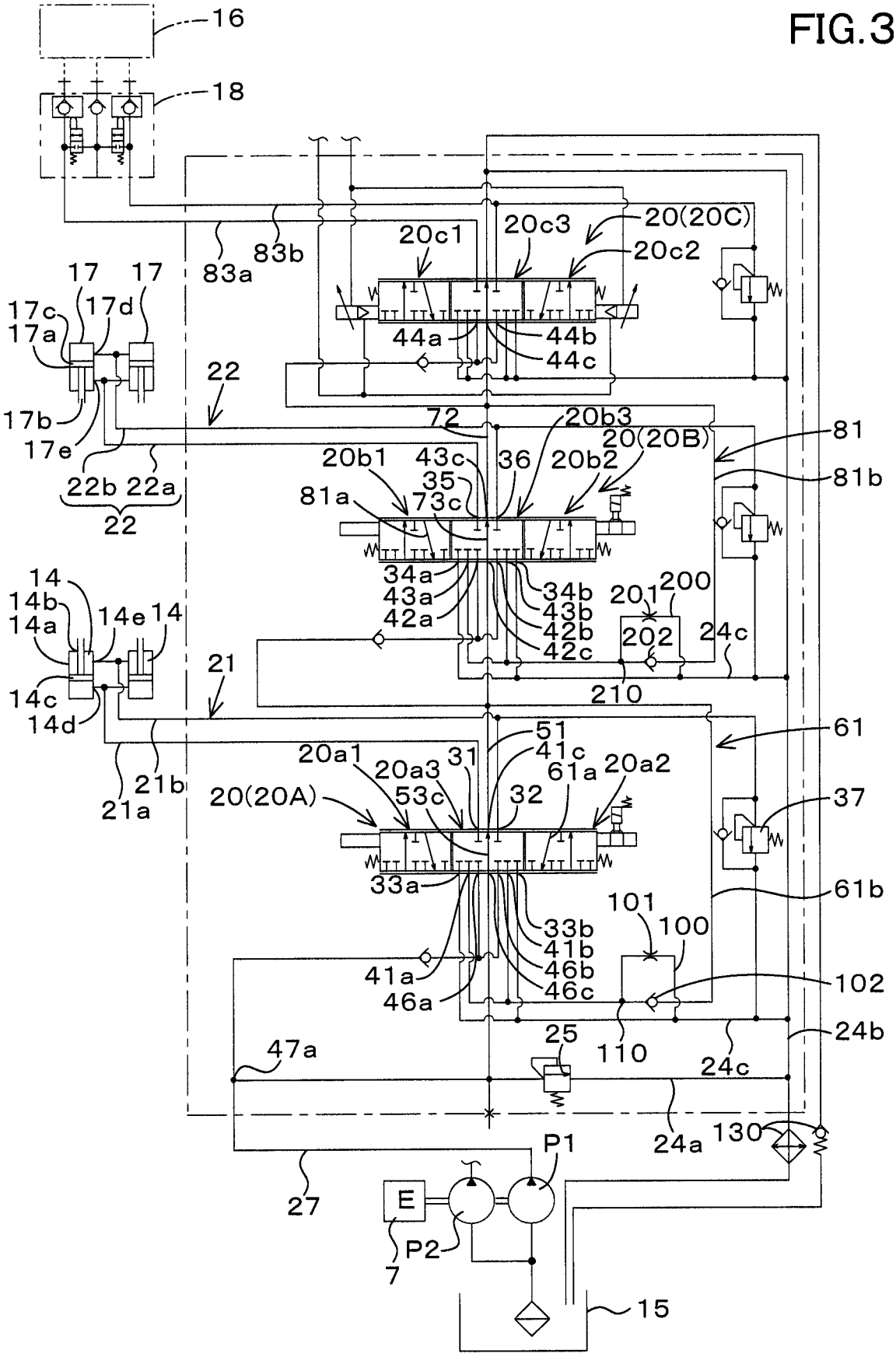
FIG. 3 is a view illustrating a hydraulic system (a hydraulic circuit) according to a second embodiment of the present invention.

FIG. 3 shows a hydraulic system (a hydraulic circuit) for a working machine according to a second embodiment of the present invention. Configurations similar to those of the first embodiment are denoted by the same reference numerals, and the description thereof is omitted. In the second embodiment, for convenience of the explanation, the bucket control valve 20B is referred to as a "first control valve", and the auxiliary control valve 20C is referred to as a "second control valve".

In addition, the bucket cylinder 17 is referred to as a "first hydraulic actuator", and the hydraulic actuator 16 is referred to as a "second hydraulic actuator". In the second embodiment, the third discharge fluid tube 24*c* is a fluid tube that is connected to the first discharging port 34*a* and the second discharging port 34*b* of the first control valve 20B and is connected to the second discharge fluid tube 24*b*.

The first control valve 20B and the second control valve 20C are coupled by a center fluid tube 72. The center fluid tube 72 couples the third output port 43*c* of the first control valve 20B and the third input port 44*c* of the second control valve 20C.

The first control valve 20B and the second control valve 20C are connected by a first fluid tube 81 in addition to the center fluid tube 72. The first fluid tube 81 is a fluid tube which supplies the return fluid to the second control valve 20C through the first control valve 20B, the return fluid returning from the first hydraulic actuator 17 to the first control valve 20B.

The first fluid tube 81 includes the second connecting fluid tube (the first return fluid tube) 22*b*, the internal fluid tube 81*a*, and the external fluid tube 81*b*. The second connecting fluid tube 22*b* is a fluid tube that couples the second port 36 of the first control valve 20B and the first port 17*d* of the first hydraulic actuator 17, that is, the first return fluid tube in which the return fluid discharged from the first port 17*d* flows.

The internal fluid tube 81*a* is a fluid tube that is provided in the first control valve 20B and communicates with the second return fluid tube 22*b*. In particular, the internal fluid tube 81*a* is a fluid tube that couples the second port 36 of the first control valve 20B and the second output port 43*b* of the first control valve 20B when the first control valve 20B is set to be in the first position 20*b*1.

The external fluid tube 81*b* is a fluid tube that communicates with the internal fluid tube 81*a* and is connected to the second control valve 20C. The external fluid tube 81*b* couples the first output port 43*a* of the first control valve 20B and the first input port 44*a* of the second control valve 20C, and couples the second output port 43*b* of the first control valve 20B and the second input port 44*b* of the second control valve 20C. A middle portion of the external fluid tube 81*b* is connected to the center fluid tube 73*c*.

Also in the second embodiment, it is possible to discharge the return fluid flowing through the external fluid tube 81*b*, or to return the operation fluid in the discharge fluid tube 24 to the external fluid tube 81*b*.

The working hydraulic system includes a branched fluid tube 200. The branched fluid tube 200 is a fluid tube provided on the downstream side of the spool of the first control valve 20B, and is a return fluid branched from the external fluid tube 81*b* and discharges, to the discharging portion, the return fluid flowing through the external fluid tube 81*b*.

In particular, one end of the branched fluid tube 200 is connected to the external fluid tube 81*b*, and the other end is connected to the third discharge fluid tube 24*c*.

A throttle portion 201 is connected to the branched fluid tube 200. The throttle portion 201 is configured, for example, by making a partial portion of the branched fluid tube 200 thinner than other portions. In other words, the throttle portion 201 is configured by making the cross-sectional area of the portion where the operation fluid flows in the branched fluid tube 200 smaller than other portions. In addition, the structure of the branched fluid tube 200 is not limited to the example mentioned above.

A check valve 202 is connected to the external fluid tube 81*b*. The check valve 202 is a valve that allows the return fluid to flow from the first control valve 20B to the second control valve 20C and blocks the operation fluid from flowing from the second control valve 20C to the branched fluid tube 200.

In particular, the check valve 202 is arranged on a section between the first connecting portion 210 that couples the external fluid tube 81*b* and the branched fluid tube 200 and a second connecting portion (the first input port 44*a*, the second input port 44*b*) that couples the external fluid tube 81*b* and the second control valve 20C.

In this manner, when the first control valve 20B is set to be in the first position (the shoveling position) 20*b*1, a flow rate of the return fluid returning from the first hydraulic actuator 17 to the second control valve 20C through the second return fluid tube 22*b*, the internal fluid tube 81*a*, and the external fluid tube 81*b* is extremely reduced under the state where the first hydraulic actuator 17 is shortened to the stroke end (an end portion).

In addition, under the state where the first hydraulic actuator 17 is shortened to the stroke end (the end portion), the third input port 42*c* and the third output port 43*c* are not in communication in the first control valve 20B, and the communication is closed between the third input port 42*c* and the third output port 43*c*. Thus, the operation fluid of the first hydraulic pump P1 flows, to the first discharged fluid tube 24*a*. through the main relief valve 25.

Here, since the second discharge fluid tube 24*b* is provided with the pressurizing portion 130, the operation fluid in the third discharge fluid tube 24*c* communicating with the second discharge fluid tube 24*b* flows, to the external fluid tube 81*b*, through the branched fluid tube 200.

That is, when the first hydraulic actuator 17 is shortend to the stroke end, a flow rate of the return fluid returning from the first hydraulic actuator 17 toward the external fluid tube 81*b* is low. However, the operation fluid flowing from the discharge fluid tube 24 (the third discharge fluid tube 24*c*) is supplemented to the operation fluid flowing to the external fluid tube 81*b*, and thus the second control valve 20C can be moved smoothly.

As shown in FIG. 4B, in the external fluid tube 81*b*, a check valve 202 may be provided on the upstream side of the confluent portion 211 where the fluid tube connected to the first output port 43*a* is confluent with the fluid tube connected to the second output port 43*b*. In this case, in the external fluid tube 81*b*, the branched fluid tube 200 is connected to the section between the first control valve 20B to the confluent portion 211, that is, the section on which the check valve 202 is provided.

In this manner, when the first hydraulic actuator 17 is operated, that is, when the bucket 11 is moved in the shoveling operation (when the bucket control valve 20B is set to be in the first position 20*b*1), the operation fluid in the discharge fluid tube 24 (the third discharge fluid tube 24*c*) can be supplemented to the external fluid tube 81*b* through the branched fluid tube 200.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The first control valve and the second control valve are not limited to those of the embodiments mentioned above, and maybe any control valves provided in the working machine. In the embodiment described above, the hydraulic pump is a constant displacement pump (also referred to as a fixed displacement pump). However, for example, the hydraulic pump may be a variable displacement pump configured to change the outputting rate by changing the angle of swash plate, or may be another type of hydraulic pump.

In addition, in the first embodiment, the second embodiment, and the first modified example to the third modified example described above, the hydraulic system may constituted of any combinations of the branched fluid tubes 100 and 200, the throttle portions 101 and 201, and the check valves 102 and 202 as appropriate.

Third Embodiment

First, the working machine will be explained.

FIG. 8 shows a side view of the working machine according to the embodiments of the present invention. In FIG. 8, a skid steer loader is shown as an example of the working machine.

However, the working machine according to the present invention is not limited to the skid steerer, and may be another type of loader working machine such as a compact truck loader. In addition, a working machine other than the loader working machine may be employed.

The working machine 1 includes a machine body (a vehicle body) 2, a cabin 3, a working device 4, a traveling device 5A, and a traveling device 5B.

The cabin 3 is mounted on the machine body 2. An operator seat 8 is arranged at the rear portion of the cabin 3. In explanation of the embodiments, the front side of the operator seated on the operator seat 8 of the working machine 1 (the left side in FIG. 8) is referred to as the front, the rear side of the operator (the right side in FIG. 8) is referred to as the rear, the left side of the operator (the front surface side of FIG. 8) is referred to as the left, and the right side of the operator (the back surface side of FIG. 8) is referred to as the right.

The horizontal direction, which is a direction orthogonal to the front-rear direction, will be described as a machine width direction. The direction from the center portion of the machine body 2 toward the right portion or the left portion will be described as a machine outward direction. In other words, the machine outward direction is the machine width direction and separates away from the machine body 2.

The direction opposite to the machine outward direction will be described as the machine inward direction. In other words, the machine inward direction is the machine width direction and is the direction approaching the machine body 2.

The cabin 3 is mounted on the machine body 2. The working device 4 is a device that performs the working, and is installed on the machine body 2. The traveling device 5A is a device provided for the traveling of the machine body 2, and is arranged on the left side of the machine body 2. The traveling device 5B is a device provided for the traveling of the machine body 2, and is arranged on the right side of the machine body 2.

A prime mover 7 is arranged inside at the rear portion of the machine body 2. The prime mover 7 is a diesel engine (an engine). The prime mover 7 is not limited to the engine, and may be an electric motor or the like.

A traveling lever 9L is arranged on the left side of the operator seat 8. A traveling lever 9R is arranged on the right side of the operator seat 8. The traveling lever 9L arranged on the left is provided for operating the traveling device 5A arranged on the left, and the traveling lever 9R arranged on the right is provided for operating the traveling device 5B arranged on the right.

The working device 4 includes a boom 10, a bucket 11, a lift link 12, a control link 13, a boom cylinder 14, and a bucket cylinder 17. The boom 10 is arranged on the side of the machine body 2. The bucket 11 is arranged on the tip end (a front end) of the boom 10.

The lift link 12 and the control link 13 support the base portion (a rear portion) of the boom 10. The boom cylinder 14 moves the boom 10 upward or downward.

In particular, the lift link 12, the control link 13, and the boom cylinder 14 are arranged on the side of the machine body 2. The upper portion of the lift link 12 is pivotally supported by the upper portion of the base portion of the boom 10. The lower portion of the lift link 12 is pivotally supported on the side portion of the rear portion of the machine body 2.

The control link 13 is arranged in front of the lift link 12. One end of the control link 13 is pivotally supported by the lower portion of the base portion of the boom 10, and the other end is pivotally supported by the machine body 2.

The boom cylinder 14 is a hydraulic cylinder configured to move the boom 10 upward and downward. The upper portion of the boom cylinder 14 is pivotally supported by the front portion of the base portion of the boom 10. The lower portion of the boom cylinder 14 is pivotally supported by the side portion of the rear portion of the machine body 2.

When the boom cylinder 14 is stretched and shortened, the boom 10 is swung up and down by the lift link 12 and the control link 13. The bucket cylinder 17 is a hydraulic cylinder configured to swing the bucket 11. The bucket cylinder 17 couples the left portion of the bucket 11 and the left boom, and couples the right portion of the bucket 11 and the right boom.

An auxiliary attachment such as a hydraulic crusher, a hydraulic breaker, an angle broom, an auger, a pallet fork, a sweeper, a mower, and a snow blower can be attached to the tip end (a front portion) of the boom 10 instead of the bucket 11.

In the present embodiment, the traveling devices 5A and 5B respectively employ wheel type traveling devices 5A and 5B each of which has a front wheel 5F and a rear wheel 5R. Note that the traveling devices 5A and 5B may respectively employ crawler type (including semi-crawler type) traveling devices 5A and 5B.

Next, a working hydraulic circuit (a working hydraulic system) provided in the skid steer loader 1 will be described.

Figure 5:
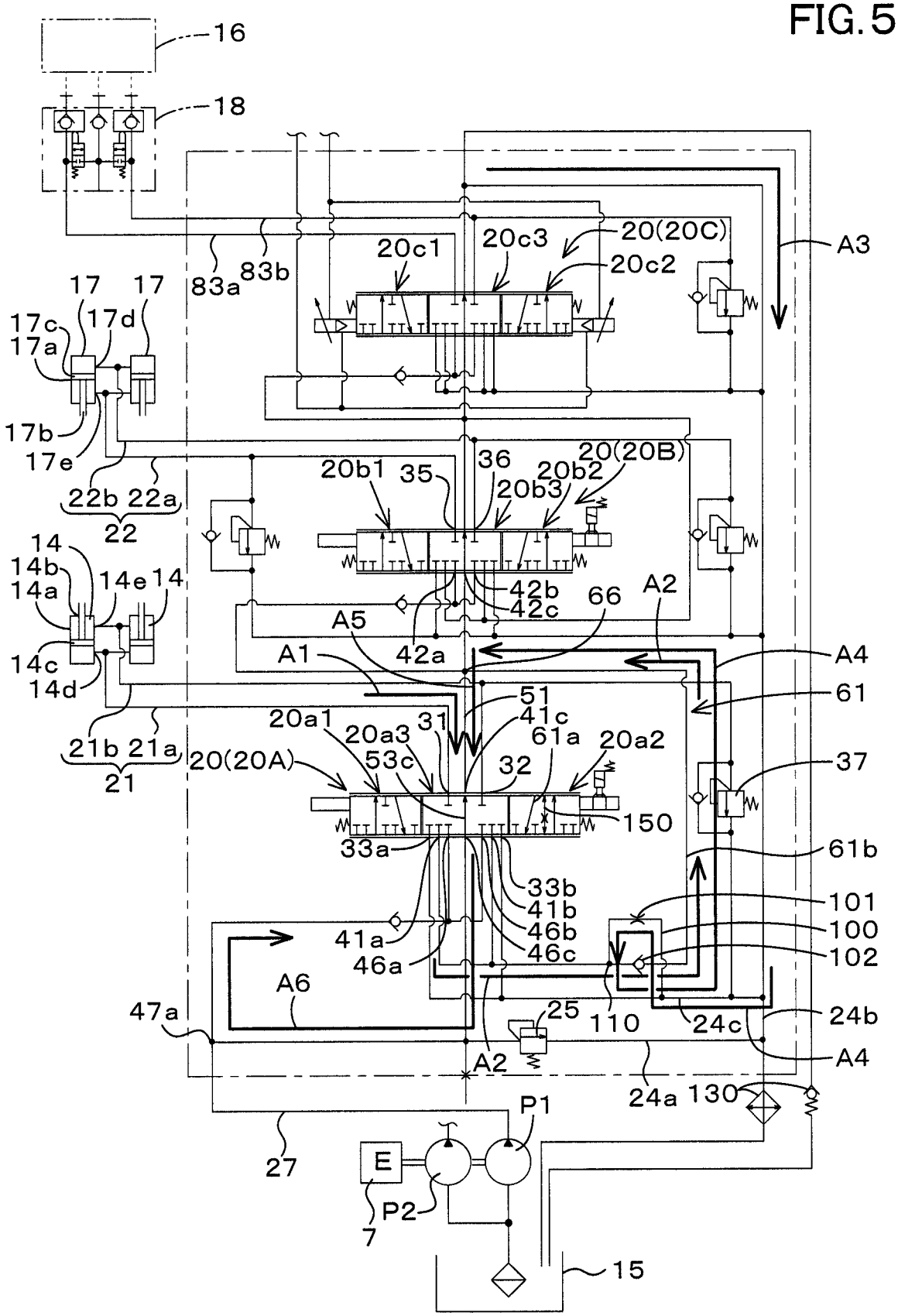
FIG. 5 is a view illustrating a hydraulic system (a hydraulic circuit) according to a third embodiment of the present invention.

The working hydraulic system is a system for operating the boom 10, the bucket 11, the auxiliary attachment, and the like. As shown in FIG. 5, the working hydraulic system includes a plurality of control valves 20 and a hydraulic pump P1 (a first hydraulic pump) for the working. In addition, the working hydraulic system includes a second hydraulic pump P2 different from the first hydraulic pump P1.

The first hydraulic pump P1 is a pump configured to be operated by the power of the prime mover 7, and is constituted of a constant displacement gear pump (a fixed displacement gear pump). The first hydraulic pump P1 is configured to output the operation fluid stored in the tank 15 (the operation fluid tank).

The second hydraulic pump P2 is a pump configured to be operated by the power of the prime mover 7, and is constituted of a constant displacement gear pump (a fixed displacement gear pump). The second hydraulic pump P2 is configured to output the operation fluid stored in the tank 15 (the operation fluid tank).

The second hydraulic pump P2 outputs the operation fluid for signal and the operation fluid for control in the hydraulic system. The operation fluid for signal and the operation fluid for control are referred to as the pilot fluid.

The plurality of control valves 20 are valves configured to control various hydraulic actuators provided in the working machine 1. The hydraulic actuator is a device configured to be operated with the operation fluid, such as a hydraulic cylinder or a hydraulic motor. In this embodiment, the plurality of control valves 20 includes a boom control valve 20A, a bucket control valve 20B, and an auxiliary control valve 20C.

The boom control valve 20A is a valve configured to control a hydraulic actuator 14 (a boom cylinder) that operates the boom 10. The boom control valve 20A is a three-position switching valve of direct-acting spool type.

The boom control valve 20A is switched between a neutral position 20*a*3, a first position 20*a*1 other than the neutral position 20*a*3, a second position 20*a*2 other than the neutral position 20*a*3 and the first position 20*a*1. The first position 20*a*1 and the second position 20*a*2 are the side positions.

In the boom control valve 20A, the switching between the neutral position 20*a*3, the first position 20*a*1, and the second position 20*a*2 are performed by moving the spool through the operation of the operation member. The switching of the boom control valve 20A is performed by directly moving the spool through operation of the operation member. However, the spool may be moved by the hydraulic operation (the hydraulic operation by the pilot valve, the hydraulic operation by the proportional valve). In addition, the spool may be moved by an electric operation (an electric operation by magnetizing a solenoid) or may be moved by other methods.

The boom control valve 20A and the first hydraulic pump P1 are connected by an output fluid tube 27. In addition, the boom control valve 20A and the boom cylinder 14 are connected by a fluid tube 21.

In particular, the boom cylinder 14 includes a cylinder body 14*a*, a rod 14*b* provided movably on the cylinder body 14*a*, and a piston 14*c* provided on the rod 14*b*. A first port 14*d* through which the operation fluid is supplied and discharged is provided at the base end portion of the cylinder body 14*a* (at the side opposite to the rod 14*b* side). A second port 14*e* through which the operation fluid is supplied and discharged is provided at the tip end (at the rod 14*b* side) of the cylinder body 14*a*.

The fluid tube 21 includes a first connecting fluid tube 21*a* that connects the first port 31 of the boom control valve 20A and the first port 14*d* of the boom cylinder 14, and includes a second connecting fluid tube 21*b* that connects the second port 32 of the boom control valve 20A and the second port 14*e* of the boom cylinder 14.

Thus, when the boom control valve 20A is set to be in the first position (the lifting position) 20*a*1, the operation fluid can be supplied from the first connecting fluid tube 21*a* to the first port 14*d* of the boom cylinder 14. In addition, the operation fluid can be discharged from the second port 14*e* of the boom cylinder 14 to the second connecting fluid tube 21*b*. In this manner, the boom cylinder 14 is stretched, and thereby the boom 10 is lifted.

When the boom control valve 20A is set to be in the second position (the lowering position) 20*a*2, othe peration fluid can be supplied from the second connecting fluid tube 21*b* to the second port 14*e* of the boom cylinder 14. In addition, the operation fluid can be discharged from the first port 14*d* of the boom cylinder 14 to the first connecting fluid tube 21*a*. In this manner, the boom cylinder 14 is shortened and thereby the boom 10 is lowered.

The bucket control valve 20B is a valve configured to control a hydraulic cylinder (a bucket cylinder) 17 that controls the bucket 11. The bucket control valve 20B is a direct acting spool type three-position switching valve of pilot type. The bucket control valve 20B is switched between a neutral position 20*b*3, a first position 20*b*1 different from the neutral position 20*b*3, and a second position 20*b*2 different from the neutral position 20*b*3 and the first position 20*b*1. The second position 20*b*2 different from the first position 20*b*1 is the side position.

In the bucket control valve 20B, the switching between the neutral position 20*b*3, the first position 20*b*1, and the second position 20*b*2 is performed by moving the spool through operation of the operation member. The switching of the bucket control valve 20B is switched by directly moving the spool through the manual operation of the operation member.

However, the spool may be moved by the hydraulic operation (the hydraulic operation by the pilot valve, the hydraulic operation by the proportional valve). In addition, the spool may be moved by an electric operation (an electric operation by magnetizing a solenoid) or may be moved by other methods.

The bucket control valve 20B and the bucket cylinder 17 are connected by a fluid tube 22. In particular, the bucket cylinder 17 includes a cylinder body 17*a*, a rod 17*b* that is movably provided on the cylinder body 17*a*, and a piston 17*c* that is provided on the rod 17*b*. A first port 17*d* through which the operation fluid is supplied and discharged is provided at the base end portion of the cylinder body 17*a* (the side opposite to the rod 17*b* side). A second port 17*e* through which the operation fluid is supplied and discharged is provided at the tip end (the rod 17*b* side) of the cylinder body 17*a*.

The fluid tube 22 includes a first connecting fluid tube 22*a* that connects the first port 35 of the bucket control valve 20B and the second port 17*e* of the bucket cylinder 17, and a second connecting fluid tube 22*b* that connects a second port 36 of the bucket control valve 20B and the first port 17*d* of the bucket cylinder 17.

Thus, when the bucket control valve 20B is set to be in the first position (the shoveling position) 20*b*1, the operation fluid can be supplied from the first connecting fluid tube 22*a* to the second port 17*e* of the bucket cylinder 17. In addition, the operation fluid can be discharged from the first port 17*d* of the bucket cylinder 17 to the second connecting fluid tube 22*b*. In this manner, the bucket cylinder 17 is shortened and thereby the bucket 11 performs the shoveling operation.

When the bucket control valve 20B is set to be in the second position (the dumping position) 20*a*2, the operation fluid can be supplied from the second connecting fluid tube 22*b* to the first port 17*d* of the bucket cylinder 17. In addition, the operation fluid can be discharged from the second port 17*e* of the bucket cylinder 17 to the first connecting fluid tube 22*a*. In this manner, the bucket cylinder 17 is stretched and thereby performs the dumping operation.

The auxiliary control valve 20C is a valve configured to control the hydraulic actuator (the hydraulic cylinder, the hydraulic motor, and the like) 16 mounted on the auxiliary attachment. The auxiliary control valve 20C is a direct acting spool type three-position switching valve of pilot type. The auxiliary control valve 20C is switched between a neutral position 20*c*3, a first position 20*c*1 different from the neutral position 20*c*3, and a second position 20*c*2 different from the first position 20*c*1 and the neutral position 20*c*3.

In the auxiliary control valve 20C, the switching between the neutral position 20*c*3, the first position 20*c*1, and the second position 20*c*2 is switched by moving the spool with a pressure of the pilot fluid. A connecting member 18 is connected to the auxiliary control valve 20C by the supply/discharge fluid tube 83*a* and the supply/discharge fluid tube 83*b*. The connecting member 18 is connected to a fluid tube connected to the hydraulic actuator 16 (an auxiliary hydraulic actuator) for the auxiliary attachment.

Thus, when the auxiliary control valve 20C is set to the first position 20*c*1, the operation fluid can be supplied from the supply/discharge fluid tube 83*a* to the hydraulic actuator 16 of the auxiliary attachment. When the auxiliary control valve 20C is set to be in the second position 20*c*2, the operation fluid can be supplied from the supply/discharge fluid tube 83*b* to the hydraulic actuator 16 of the auxiliary attachment.

In this manner, when the operation fluid is supplied, to the hydraulic actuator 16, from the supply/discharge fluid tube 83*a* or the supply/discharge fluid tube 83*b*, the hydraulic actuator 16 (the auxiliary attachment) can be operated.

Now, the hydraulic system according to the embodiment employs a series circuit (a series fluid tube). In the series circuit, the operation fluid returned from the hydraulic actuator to the control valve arranged on the upstream side can be supplied to the control valve arranged on the downstream side. For example, focusing on the boom control valve 20A and the bucket control valve 20B, the boom control valve 20A is a control valve arranged on the upstream side, and the bucket control valve 20B is a control valve arranged on the downstream side.

Hereinafter, the control valve arranged on the upstream side is referred to as a "first control valve", and the control valve arranged on the downstream side is referred to as a "second control valve". In addition, the hydraulic actuator corresponding to the first control valve is referred to as a "first hydraulic actuator", and the hydraulic actuator corresponding to the second control valve is referred to as a "second hydraulic actuator". The fluid tube that supplies, to the second control valve, the return fluid which is the operation fluid that returns from the first hydraulic actuator to the first control valve is referred to as a "first fluid tube".

In this embodiment, the boom control valve 20A is the "first control valve", and the bucket control valve 20B is the "second control valve". In addition, the boom cylinder 14 is the "first hydraulic actuator", and the bucket cylinder 17 is the "second hydraulic actuator".

Hereinafter, the first control valve and the second control valve will be described in detail. The first control valve 20A and the output portion of the first hydraulic pump P1 are connected by the output fluid tube 27. The output fluid tube 27 is branched at the middle portion 47*a*, and reaches the first control valve 20A.

The fluid tube branched from the output fluid tube 27 is connected to the first input port 46*a* and the second input port 46*b* of the first control valve 20A. In addition, the output fluid tube 27 is connected to the third input port 46*c* of the first control valve 20A.

In this manner, the operation fluid outputted from the first hydraulic pump P1 is capable of being supplied into the first control valve 20A through the output fluid tube 27, the first input port 46*a*, the second input port 46*b*, and the third input port 46*c*. In the output fluid tube 27, the discharge fluid tube 24 capable of discharging the operation fluid is connected to a section between the middle portion 47*a* and the third input port 46*c*.

The discharge fluid tube 24 includes a first discharge fluid tube 24*a* provided with a relief valve (a main relief valve) 25 that is capable of discharging the operation fluid when the pressure in the output fluid tube 27 becomes a predetermined pressure or more (a set pressure or more), a second discharge fluid tube 24*b* that is connected to the first discharge fluid tube 24*a* and reaches a discharging portion through which the operation fluid is discharged, and a third discharge fluid tube 24*c* that is connected to the second discharge fluid tube 24*b* and reaches the first discharging port 33*a* and the second discharge port 33*b* of the first control valve 20A.

The discharging portion is an operation fluid tank and a suction portion of the hydraulic pump (a portion through which the operation fluid is sucked). In addition, the discharging portion should just be a portion from which the operation fluid is discharged, and may be other than the operation fluid tank and the suction portion of the hydraulic pump, and is not limited thereto.

A pressurizing portion 130 is provided in the second discharge fluid tube 24*b*. The pressurizing portion 130 is a portion configured to increase the pressure in the discharged fluid tube 24. In addition, the pressurizing portion 130 is provided in the fourth discharge fluid tube arranged in parallel with the second discharge fluid tube 24*b* in the discharge fluid tube 24.

The pressurizing portion 130 is an oil cooler, a relief valve, a throttle portion (a throttle valve), a choke valve, a check valve, or the like. A plurality of the pressurizing portions 130 may be provided in the second discharge fluid tube 24*b*, and may be arranged in series or in parallel.

In addition, two of the discharge fluid tubes 24 are provided extending from the control valve arranged on the most downstream side. However, the number of the discharge fluid tube 24 may be one, and the number of the pressurizing portions 130 may be one when the number of the discharge fluid tube 24 is one.

The first control valve 20A and the second control valve 20B are connected by a center fluid tube 51. The center fluid tube 51 connects the third output port 41*c* of the first control valve 20A and the third input port 42*c* of the second control valve 20B.

In addition to the center fluid tube 51, the first control valve 20A and the second control valve 20B are connected by the first fluid tube 61. The first fluid tube 61 is a fluid tube allowing the return fluid returning from the first hydraulic actuator 14 to the first control valve 20A to flow through the first control valve 20A and to be supplied to the second control valve 20B.

The first fluid tube 61 includes the first connecting fluid tube (the first return fluid tube) 21*a*, the internal fluid tube 61*a*, and the external fluid tube 61*b*. The first connecting fluid tube 21*a* is a fluid tube that connects the first port 31 of the first control valve 20A and the first port 14*d* of the first hydraulic actuator 14, that is, a first return fluid tube through which the return fluid discharged from the first port 14*d* of the first hydraulic actuator 14 flows.

The internal fluid tube 61*a* is a fluid tube that is provided in the first control valve 20A and communicates with the first return fluid tube 21*a*. In particular, the internal fluid tube 61*a* is a fluid tube that connects the first port 31 of the first control valve 20A and the first output port 41*a* of the first control valve 20A when the first control valve 20A is set to be in the second position 20*a*2.

The external fluid tube 61*b* is a fluid tube that is connected to the second control valve 20B and communicates with the internal fluid tube 61*a*. The external fluid tube 61*b* connects the first output port 41*a* of the first control valve 20A and the first input port 42*a* of the second control valve 20B, and connects the second output port 41*b* of the first control valve 20A and the second input port 42*b* of the second control valve 20B. A middle portion of the external fluid tube 61*b* is connected to the center fluid tube 53*c*.

In addition, the working hydraulic system is provided with a second internal fluid tube 150 separately from the first internal fluid tube 61*a*. The second internal fluid tube 150 is a fluid tube that communicates with the external fluid tube 61*b* when the first control valve 20A is switched to a predetermined switching position.

In particular, the second internal fluid tube 150 is a fluid tube that couples a third output port 41*c* of the first control valve 20A and a third input port 46*c* of the first control valve 20A when the first control valve 20A is set to be in the second position 20*a*2.

In addition, the working hydraulic system includes a branched fluid tube 100. The branched fluid tube 100 is a fluid tube provided on the downstream side of the spool of the first control valve 20A and branched from the external fluid tube 61*b*, that is, a fluid tube through which the return fluid having flowed in the external fluid tube 61*b* flows. One end of the branched fluid tube 100 is connected to the external fluid tube 61*b*, and the other end is connected to the third discharge fluid tube 24*c*.

A throttle portion 101 is connected to the branched fluid tube 100. The throttle portion 101 is configured, for example, by making a partial portion of the branched fluid tube 100 thinner than other portions. In other words, the throttle portion 101 is configured by making the cross-sectional area of the portion where the operation fluid flows in the branched fluid tube 100 smaller than other portions. In addition, the structure of the branched fluid tube 100 is not limited to the example mentioned above.

A check valve 102 is connected to the external fluid tube 61*b*. The check valve 102 is a valve that allows the return fluid to flow from the first control valve 20A to the second control valve 20B and blocks the operation fluid from flowing from the second control valve 20B to the branched fluid tube 100.

In particular, the check valve 102 is arranged on a section between the first connecting portion 110 that connects the external fluid tube 61*b* and the branched fluid tube 100 and a second connecting portion (the first input port 42*a*, the second input port 42*b*) that connects the external fluid tube 61*b* and the second control valve 20C.

According to the above configuration, when the first control valve 20A is set to be in the second position (the lowering position) 20*a*2, the first connecting fluid tube (the first return fluid tube) 21*a*, the first internal fluid tube 61*a*, and the external fluid tube 61*b* are coupled. In this manner, as indicted by the arrowed line A1 in FIG. 5, the return fluid that has returned from the first hydraulic actuator 14 to the first control valve 20A flows toward the external fluid tube 61*b* through through the first return fluid tube 21*a* and the first internal fluid tube 61*a*.

In addition, as indicated by the arrowed line A2, the operation fluid that has flowed from the first internal fluid tube 61*a* to the external fluid tube 61*b* flows to the second control valve 20B through the check valve 102 of the external fluid tube 61*b* and through the connection portion 66 (a connecting portion connecting between the center fluid tube 51 and the external fluid tube 61*b*).

Here, considering the case where that the operation fluid supplied from the first control valve 20A to the first hydraulic actuator 14 is reduced, that is, where a flow rate of the operation fluid supplied from the output fluid tube 27 to the second input port 46*b* of the first control valve 20A (the supplied fluid) is low (the shortage of the operation fluid).

In the shortage of the operation fluid, as indicated by arrowed lines A3 and A4 in FIG. 5, the operation fluid discharged from the downstream side of the first control valve 20A to the discharge fluid tube 24 flows into the second discharge fluid tube 24*b* and flows into the third discharge fluid tube 24*c*, and then flows from the branched fluid tube 100 to the external fluid tube 61*b*.

That is, since the pressurizing portion 130 is provided in the second discharge fluid tube 24*b*, at least a part of the operation fluid flowing in the second discharge fluid tube 24*b* returns to the external fluid tube 61*b* through the third discharge fluid tube 24*c* and the branched fluid tube 100.

In addition, when the first control valve 20A is set to be in the second position (the lowering position) 20*a*2, the third output port 41*c* of the first control valve 20A and the third input 46*c* of the first control valve 20A are coupled by the second internal fluid tube 150. In this manner, as indicated by the arrowed line A5 in FIG. 5, the operation fluid that has returned to the external fluid tube 61*b* through the third discharge fluid tube 24*c* and the branched fluid tube 100 enters the first control valve 20A from the third output port 41*c* through the connection portion 66, and returns to the output fluid tube 27 from the third input port 46*c* through the second internal fluid tube 150.

As indicated by the arrowed line A6 in FIG. 5, the operation fluid that has returned to the output fluid tube 27 flows toward the first control valve 20A through the middle portion 47*a*, and is supplied from the second input port 46*b* to the first control valve 20A. The operation fluid supplied to the first control valve 20A is supplied to the first hydraulic actuator 14 from the second port 32 of the first control valve 20A through the second connecting fluid tube 21*b*.

As described above, since the hydraulic system is provided with the second internal fluid tube 150, the pressurizing portion 130, and the branched fluid tube 100, the operation fluid in the discharge fluid tube 24 can be used for supplement when the supplied fluid to be supplied to the first hydraulic actuator 14 runs short.

Fourth Embodiment

Figure 6:
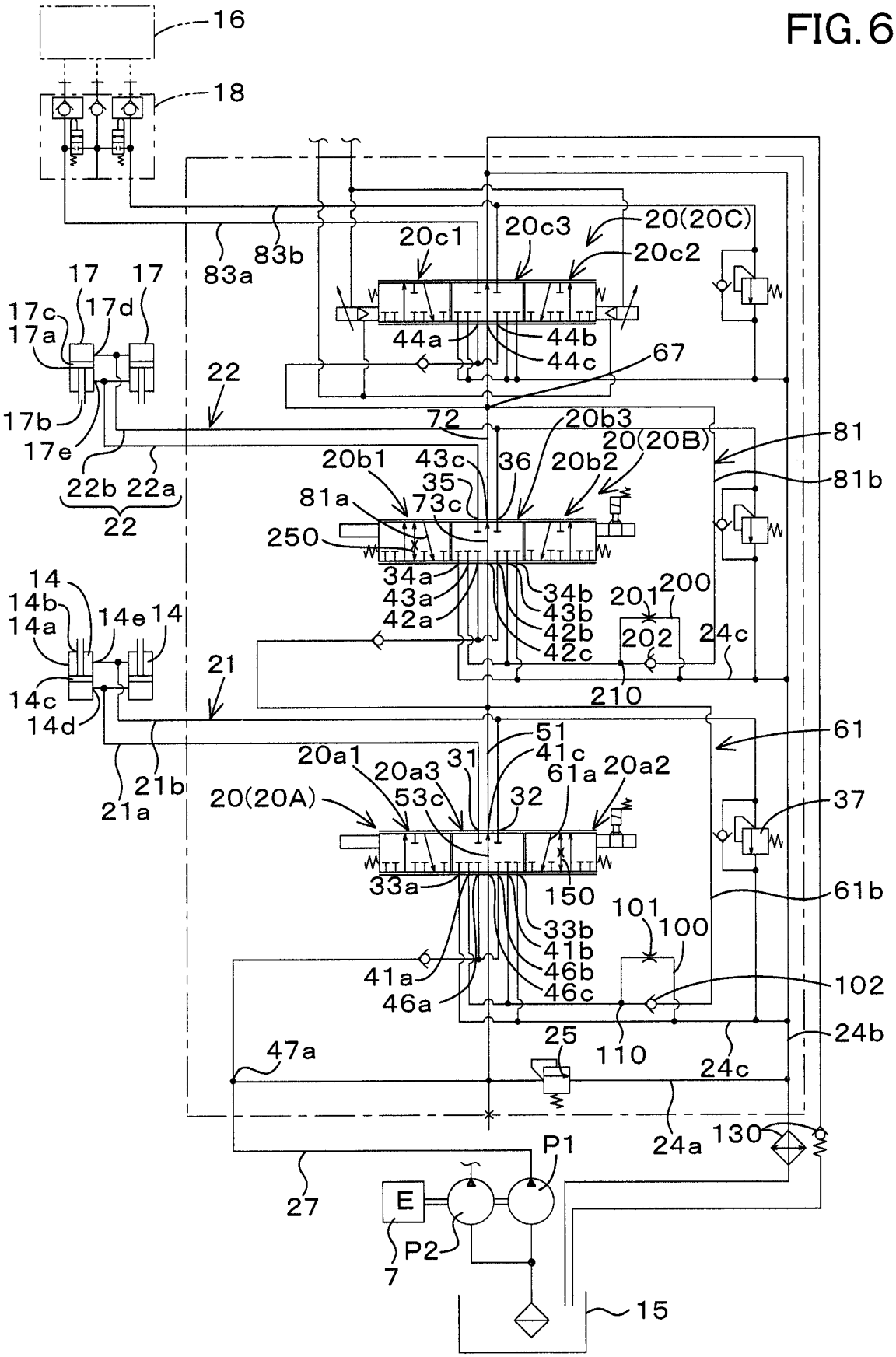
FIG. 6 is a view illustrating a hydraulic system (a hydraulic circuit) according to a fourth embodiment of the present invention.

FIG. 6 shows a hydraulic system (a hydraulic circuit) for a working machine according to a fourth embodiment of the present invention. Explanations of configurations similar to those of the first embodiment to the third embodiment will be omitted by giving the same reference numerals to the similar configurations.

In the fourth embodiment, for convenience of the explanation, the bucket control valve 20B is referred to as a "first control valve", and the auxiliary control valve 20C is referred to as a "second control valve". In addition, the bucket cylinder 17 is referred to as a "first hydraulic actuator", and the hydraulic actuator 16 is referred to as a "second hydraulic actuator".

The first control valve 20B and the second control valve 20C are connected (coupled) by a center fluid tube 72. The center fluid tube 72 connects (couples) the third output port 43*c* of the first control valve 20B and the third input port 44*c* of the second control valve 20C.

In addition to the center fluid tube 72, the first control valve 20B and the second control valve 20C are coupled (connected) by a first fluid tube 81. The first fluid tube 81 is a fluid tube through which the return fluid returning from the first hydraulic actuator 17 to the first control valve 20B is supplied to the second control valve 20C through the first control valve 20B.

The first fluid tube 81 has a second connecting fluid tube 22*b* (a first return fluid tube), a first internal fluid tube 81*a*, and an external fluid tube 81*b*. The second connecting fluid tube 22*b* is a fluid tube connecting the second port 36 of the first control valve 20B and the first port 17*d* of the first hydraulic actuator 17, and is the first return fluid tube through which the return fluid discharged from the first port 17*d* flows.

The first internal fluid tube 81*a* is a fluid tube provided in the first control valve 20B and communicated with (connected to) the second return fluid tube 22*b*. In particular, the first internal fluid tube 81*a* is a fluid tube that connects the second port 36 of the first control valve 20B and the second output port 43*b* of the first control valve 20B when the first control valve 20B is set to be in the first position 20*b*1.

The external fluid tube 81*b* is a fluid tube that communicates with the first internal fluid tube 81*a* and is connected to the second control valve 20C. The external fluid tube 81*b* connects the first output port 43*a* of the first control valve 20B and the first input port 44*a* of the second control valve 20C, and connects the second output port 43*b* of the first control valve 20B and the second input port 44*b* of the second control valve 20C. A middle portion of the external fluid tube 81*b* is connected to the center fluid tube 73*c*.

Also in the fourth embodiment, it is possible to discharge the return fluid that flows through the external fluid tube 81*b*, or return the operation fluid in the discharge fluid tube 24 to the external fluid tube 81*b*. The working hydraulic system includes a branched fluid tube 200.

The branched fluid tube 200 is a fluid tube provided on the downstream side of the spool of the first control valve 20B, and branched from the external fluid tube 81*b* and configured to discharge, to the discharging portion, the return fluid passing through the external fluid tube 81*b*. In particular, one end of the branched fluid tube 200 is connected to the external fluid tube 81*b*, and the other end is connected to the third discharge fluid tube 24*c*.

A throttle portion 201 is connected to the branched fluid tube 200. The throttle portion 201 is configured, for example, by making a partial portion of the branched fluid tube 200 thinner than other portions. In other words, the throttle portion 201 is configured by making the cross-sectional area of the portion where the operation fluid flows in the branched fluid tube 200 smaller than other portions. In addition, the structure of the branched fluid tube 200 is not limited to the example mentioned above.

A check valve 202 is connected to the external fluid tube 81*b*. The check valve 202 is a valve that allows the return fluid to flow from the first control valve 20B to the second control valve 20C and blocks the operation fluid from flowing from the second control valve 20C to the branched fluid tube 200.

In particular, the check valve 202 is arranged on a section between the first connecting portion 210 that connects the external fluid tube 81*b* and the branched fluid tube 200 and a second connecting portion (the first input port 44*a*, the second input port 44*b*) that connects the external fluid tube 81*b* and the second control valve 20C.

In the second control valve 20C, the second internal fluid tube 250 is a fluid tube that communicates with the external fluid tube 81*b* when the first control valve 20B is switched to a predetermined switching position. In particular, the second internal fluid tube 250 is a fluid tube that connects the third output port 43*c* of the first control valve 20B and the third input port 42*c* of the first control valve 20B when the first control valve 20B is set to the first position 20*b*1.

According to the above configuration, when the first control valve 20B is set to be in the second position (a shoveling position) 20*b*1, the first connecting fluid tube 22*b* (the first return fluid tube), the first internal fluid tube 81*a*, and the external fluid tube 81*b* are connected. Thus, the return fluid that has returned from the first hydraulic actuator 17 to the first control valve 20B flows to the second control valve 20B through the first return fluid tube 22*b*, the first internal fluid tube 81*a*, the external fluid tube 81*b*, and the connecting portion 67 (the connecting portion connecting the center fluid tube 72 and the external fluid tube 81*b*).

Here, under the state where the operation fluid is insufficient in the first control valve 20B, the operation fluid discharged from the downstream side of the first control valve 20B to the discharge fluid tube 24 flows to the third discharge fluid tube 24*c*, and then flows from the branched fluid tube 200 to the external fluid tube 81*b*.

In addition, the operation fluid that has returned to the external fluid tube 81*b* through the third discharge fluid tube 24*c* and the branched fluid tube 100 flows through the connection portion 67, enters the first control valve 20B from the third output port 43*c*, flows through the second internal fluid tube 250, and then returns from the third input port 42*c* to the fluid tube 61*b* (the external fluid tube) arranged on the downstream side.

The operation fluid returned to the fluid tube 61*b* (the external fluid tube) is supplied from the first input port 44*a* of the first control valve 20B to the first control valve 20B. The operation fluid supplied to the first control valve 20B flows through the first connecting fluid tube 22*a* from the first port 35 of the first control valve 20B, and is supplied to the first hydraulic actuator 17.

As described above, since the second internal fluid tube 250, the pressurizing portion 130, and the branched fluid tube 200 are provided, the operating fluid in the discharge fluid tube 24 can be supplied when the supply fluid supplied to the first hydraulic actuator 17 is insufficient.

Figure 7A:
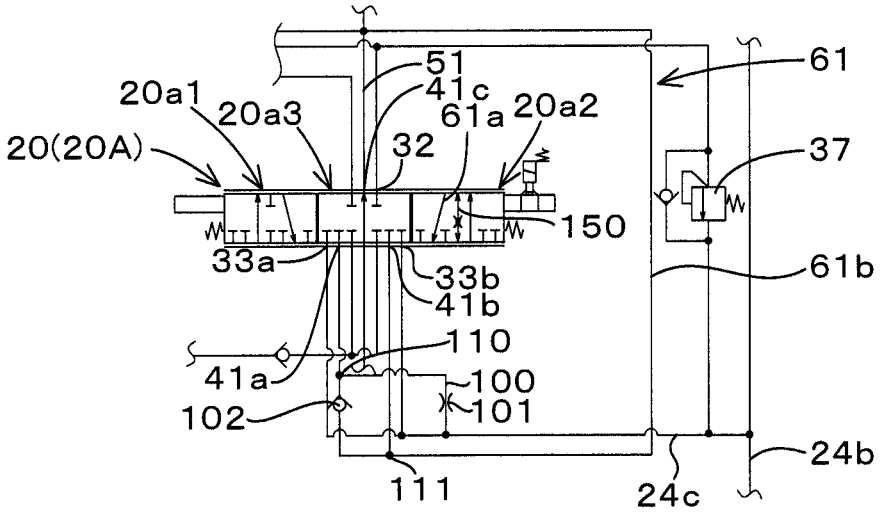
FIG. 7A is a view illustrating a first modified example of a check valve and a return discharge fluid tube according to the fourth embodiment.
Figure 7B:
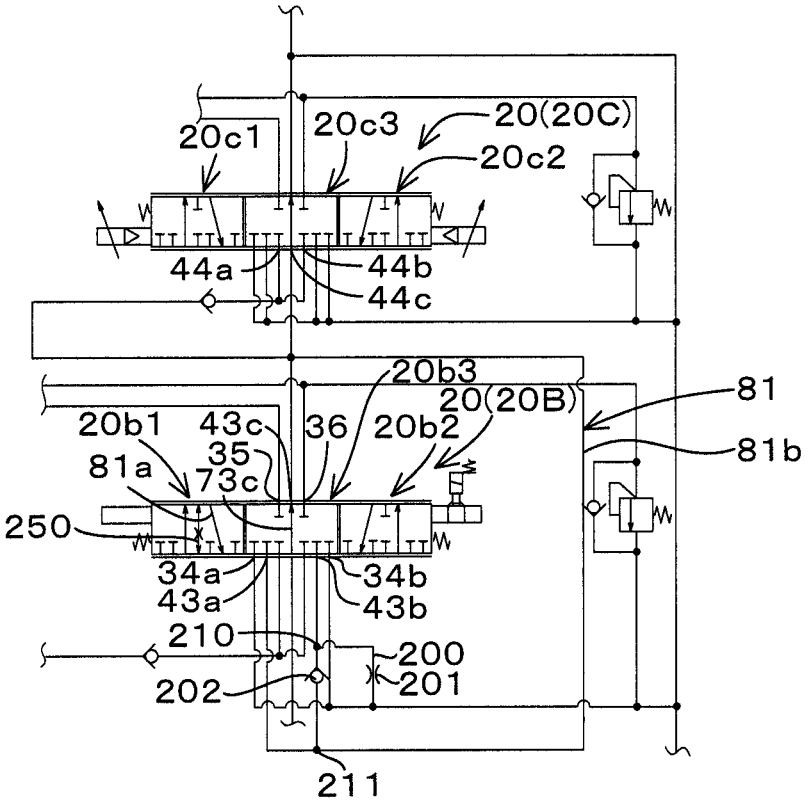
FIG. 7B is a view illustrating a second modified example of the check valve and the return discharge fluid tube according to the fourth embodiment.

In addition, the branched fluid tubes 100 and 200 and the check valves 102 and 202 can be modified as shown in FIG. 7A and FIG. 7B.

As shown in FIG. 7A, in the external fluid tube 61*b*, a check valve 102 may be provided on an upstream side of the confluent portion 111 where the fluid tube connected to the first output port 41*a* is confluent with the fluid tube connected to the second output port 41*b*.

In that case, in the external fluid tube 61*b*, the branched fluid tube 100 is connected to a section from the first output port 41*a* of the first control valve 20A to the confluent portion 111, that is, a section in which the check valve 102 is provided. In this manner, when the boom 10 is lowered (when the boom control valve 20A is set to be in the second position 20*a*2), the operation fluid in the discharge fluid tube 24 (the third discharge fluid tube 24*c*) can be supplied to the external fluid tube 61*b* through the branched fluid tube 100.

As shown in FIG. 7B, in the external fluid tube 81*b*, a check valve 202 may be provided on an upstream side of the confluent portion 211 where the fluid tube connected to the first output port 43*a* and the fluid tube connected to the second output port 43*b*. In that case, in the external fluid tube 81*b*, the return branched fluid tube 200 is connected to the section from the first control valve 20B to the confluent portion 211 in which the check valve 202 is provided.

In this manner, when the first hydraulic actuator 17, that is, the bucket 11 is moved in the shoveling motion (when the bucket control valve 20B is set to be in the first position

20*b*1), the operation fluid in the discharge fluid tube 24 (the third discharge fluid tube 24*c*) can be supplied to the external fluid tube 81*b* through the branched fluid tube 200.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The first control valve and the second control valve are not limited to those of the embodiments mentioned above, and maybe any control valves provided in the working machine.

In the embodiment described above, the hydraulic pump is a constant displacement pump (also referred to as a fixed displacement pump). However, for example, the hydraulic pump may be a variable displacement pump configured to change the discharging rate by changing the angle of swash plate, or may be another type of hydraulic pump.

What is claimed is:

1. A hydraulic system for a working machine, comprising:
a hydraulic pump to output operation fluid;
a first hydraulic actuator;
a second hydraulic actuator;
a first control valve to control the first hydraulic actuator;
a second control valve connected to a downstream side of the first control valve and configured to control the second hydraulic actuator;
a return fluid tube in which return fluid discharged from the first hydraulic actuator flows, the return fluid tube coupling the first control valve and the first hydraulic actuator;
an internal fluid tube arranged in the first control valve and connected to the return fluid tube;
an external fluid tube connected to the internal fluid tube, the external fluid tube coupling the first control valve and the second control valve;
a discharge fluid tube connected to a discharging portion for discharging the operation fluid;
a branched fluid tube branched from the external fluid tube and connected to the discharge fluid tube; and
a pressurizing portion to increase a pressure in the discharge fluid tube, the pressurizing portion being provided to the discharge fluid tube, wherein
the operation fluid in the discharge fluid tube flows to the external fluid tube through the branched fluid tube when the first control valve is in a predetermined switching position.

2. The hydraulic system according to claim 1, comprising
a check valve provided to the external fluid tube, the check valve allowing return fluid to flow from the first control valve toward the second control valve and preventing operation fluid from flowing from the second control valve to the branched fluid tube.

3. The hydraulic system according to claim 2,
wherein the check valve is arranged, in the external fluid tube, between a first connecting portion coupling the external fluid tube and the branched fluid tube and a second connecting portion coupling the external fluid tube and the second control valve.

4. The hydraulic system according to claim 2, comprising
a boom,
wherein the first hydraulic actuator is a boom cylinder to move the boom,
wherein the first control valve has:
a lifting position allowing the boom cylinder to be activated to lift the boom; and
a lowering position allowing the boom cylinder to be activated to lower the boom,
the first control valve being configured to be switched between the lifting position and the lowering position,
and wherein the first control valve allows the operation fluid in the discharge fluid tube to flow to the external fluid tube through the branched fluid tube when the first control valve is in the lowering position.

5. The hydraulic system according to claim 2, comprising
a bucket,
wherein the first hydraulic actuator is a bucket cylinder to move the bucket,
wherein the first control valve has:
a shoveling position allowing the bucket cylinder to be activated to move the bucket in a shoveling motion; and
a dumping position allowing the bucket cylinder to be activated to move the bucket in a dumping motion,
the first control valve being configured to be switched between the shoveling position and the dumping position,
and wherein the first control valve allows the operation fluid in the discharge fluid tube to flow to the external fluid tube through the branched fluid tube when the first control valve is in the shoveling position.

6. The hydraulic system according to claim 3, comprising
a bucket,
wherein the first hydraulic actuator is a bucket cylinder to move the bucket,
wherein the first control valve has:
a shoveling position allowing the bucket cylinder to be activated to move the bucket in a shoveling motion; and
a dumping position allowing the bucket cylinder to be activated to move the bucket in a dumping motion,
the first control valve being configured to be switched between the shoveling position and the dumping position,
and wherein the first control valve allows the operation fluid in the discharge fluid tube to flow to the external fluid tube through the branched fluid tube when the first control valve is in the shoveling position.

7. The hydraulic system according to claim 1, comprising
a boom,
wherein the first hydraulic actuator is a boom cylinder to move the boom,
wherein the first control valve has:
a lifting position allowing the boom cylinder to be activated to lift the boom; and
a lowering position allowing the boom cylinder to be activated to lower the boom,
the first control valve being configured to be switched between the lifting position and the lowering position,
and wherein the first control valve allows the operation fluid in the discharge fluid tube to flow to the external fluid tube through the branched fluid tube when the first control valve is in the lowering position.

8. The hydraulic system according to claim 1, comprising
a bucket,
wherein the first hydraulic actuator is a bucket cylinder to move the bucket,
wherein the first control valve has:
a shoveling position allowing the bucket cylinder to be activated to move the bucket in a shoveling motion; and a dumping position allowing the bucket cylinder to be activated to move the bucket in a dumping motion, the first control valve being configured to be switched between the shoveling position and the dumping position, and wherein the first control valve allows the operation fluid in the discharge fluid tube to flow to the external fluid tube through the branched fluid tube when the first control valve is in the shoveling position.

9. The hydraulic system according to claim 3, comprising a boom, wherein the first hydraulic actuator is a boom cylinder to move the boom, wherein the first control valve has:

a lifting position allowing the boom cylinder to be activated to lift the boom; and a lowering position allowing the boom cylinder to be activated to lower the boom, the first control valve being configured to be switched between the lifting position and the lowering position, and wherein the first control valve allows the operation fluid in the discharge fluid tube to flow to the external fluid tube through the branched fluid tube when the first control valve is in the lifting position.

10. A hydraulic system for a working machine, comprising:

a hydraulic pump to output operation fluid;

a first hydraulic actuator;

a second hydraulic actuator;

a first control valve to control the first hydraulic actuator;

a second control valve connected to a downstream side of the first control valve and configured to control the second hydraulic actuator;

a return fluid tube in which return fluid discharged from the first hydraulic actuator flows, the return fluid tube coupling the first control valve and the first hydraulic actuator;

an internal fluid tube arranged in the first control valve and connected to the return fluid tube;

an external fluid tube connected to the internal fluid tube, the external fluid tube coupling the first control valve and the second control valve;

a discharge fluid tube to discharge the operation fluid;

a branched fluid tube branched from the external fluid tube and connected to the discharge fluid tube;

a pressurizing portion to increase a pressure in the discharge fluid tube, the pressurizing portion being provided to the discharge fluid tube;

an output fluid tube coupling the hydraulic pump and the first control valve; and a main relief valve to discharge operation fluid when a pressure of the operation fluid in the output fluid tube is equal to or more than a predetermined pressure, wherein the discharge fluid tube includes:

a first discharge fluid tube having the main relief valve;

a second discharge fluid tube coupling the first discharge fluid tube and a discharging portion for discharging operation fluid and having the pressurizing portion; and a third discharge fluid tube coupling the second discharge fluid tube and the branched fluid tube.

11. The hydraulic system according to claim 10, comprising a check valve provided to the external fluid tube, the check valve allowing return fluid to flow from the first control valve toward the second control valve and preventing operation fluid from flowing from the second control valve to the branched fluid tube.

12. The hydraulic system according to claim 10, comprising a boom, wherein the first hydraulic actuator is a boom cylinder to move the boom, wherein the first control valve has:

a lifting position allowing the boom cylinder to be activated to lift the boom; and a lowering position allowing the boom cylinder to be activated to lower the boom, the first control valve being configured to be switched between the lifting position and the lowering position, and wherein the first control valve allows the operation fluid in the discharge fluid tube to flow to the external fluid tube through the branched fluid tube when the first control valve is in the lowering position.

13. The hydraulic system according to claim 10, comprising a bucket, wherein the first hydraulic actuator is a bucket cylinder to move the bucket, wherein the first control valve has:

a shoveling position allowing the bucket cylinder to be activated to move the bucket in a shoveling motion; and a dumping position allowing the bucket cylinder to be activated to move the bucket in a dumping motion, the first control valve being configured to be switched between the shoveling position and the dumping position, and wherein the first control valve allows the operation fluid in the discharge fluid tube to flow to the external fluid tube through the branched fluid tube when the first control valve is in the shoveling position.

14. The hydraulic system according to claim 11, comprising a bucket, wherein the first hydraulic actuator is a bucket cylinder to move the bucket, wherein the first control valve has:

a shoveling position allowing the bucket cylinder to be activated to move the bucket in a shoveling motion; and a dumping position allowing the bucket cylinder to be activated to move the bucket in a dumping motion, the first control valve being configured to be switched between the shoveling position and the dumping position, and wherein the first control valve allows the operation fluid in the discharge fluid tube to flow to the external fluid tube through the branched fluid tube when the first control valve is in the shoveling position.

15. A hydraulic system for a working machine, comprising:

a hydraulic pump to output operation fluid;

a first hydraulic actuator;

a second hydraulic actuator;

a first control valve to control the first hydraulic actuator when in a predetermined switching position;

a second control valve connected to a downstream side of the first control valve and configured to control the second hydraulic actuator;

a return fluid tube in which return fluid discharged from the first hydraulic actuator flows, the return fluid tube coupling the first control valve and the first hydraulic actuator;

a first internal fluid tube arranged in the first control valve and connected to the return fluid tube;

an external fluid tube connected to the first internal fluid tube, the external fluid tube coupling the first control valve and the second control valve;

a discharge fluid tube connected to a discharging portion for discharging the operation fluid;

a branched fluid tube branched from the external fluid tube and connected to the discharge fluid tube;

a pressurizing portion to increase a pressure in the discharge fluid tube, the pressurizing portion being provided to the discharge fluid tube; and a second internal fluid tube arranged in the first control valve and, when the first control valve is in the predetermined switching position, communicated with the external fluid tube to return, to the first control valve, operation fluid having flowed to the external fluid tube, wherein when the first control valve is in the predetermined switching position, the return fluid flows to the external fluid tube through the first inner fluid tube, and the operation fluid in the discharge fluid tube flows to the external fluid tube and the second inner fluid tube through the branched fluid tube.

16. The hydraulic system according to claim 15, wherein the first control valve has an input port and an output port and has:

a neutral position allowing operation fluid different from the return fluid to flow into the first control valve through the input port, pass through the first control valve, and flow out through the output port to the second control valve; and a side position that is the predetermined switching position allowing the return fluid in the first inner fluid tube to flow to the external fluid tube and allowing the operation fluid in the external fluid tube to flow into the first control valve through the output port, pass through the second inner fluid tube, flow out of the first control valve, and then flow back into the first control valve through the input port, the first control valve being configured to be switched between the neutral position and the side position.

17. The hydraulic system according to claim 16, comprising a boom, wherein the first hydraulic actuator is a boom cylinder to move the boom, wherein the side position includes:

a lifting position allowing the boom cylinder to be activated to lift the boom; and a lowering position allowing the boom cylinder to be activated to lower the boom.

18. The hydraulic system according to claim 17, wherein, when the first control valve is in the lowering position, the return fluid flows through the first inner fluid tube and the external fluid tube, and operation fluid in the discharge fluid tube flows to the external fluid tube and the second inner fluid tube through the branched fluid tube.

19. The hydraulic system according to claim 16, comprising a bucket, wherein the first hydraulic actuator is a bucket cylinder to move the bucket, wherein the first control valve has:

a shoveling position allowing the bucket cylinder to be activated to move the bucket in a shoveling motion; and a dumping position allowing the bucket cylinder to be activated to move the bucket in a dumping motion.

20. The hydraulic system according to claim 19, wherein, when the first control valve is in the shoveling position, the return fluid flows through the first inner fluid tube and the external fluid tube, and operation fluid in the discharge fluid tube flows to the external fluid tube and the second inner fluid tube through the branched fluid tube.

* * * * *